US009670926B2

(12) United States Patent
Ohnishi et al.

(10) Patent No.: US 9,670,926 B2
(45) Date of Patent: Jun. 6, 2017

(54) VARIABLE DISPLACEMENT PUMP

(71) Applicant: HITACHI AUTOMOTIVE SYSTEMS, LTD., Hitachinaka-shi, Ibaraki (JP)

(72) Inventors: Hideaki Ohnishi, Atsugi (JP); Yasushi Watanabe, Kanagawa (JP)

(73) Assignee: HITACHI AUTOMATIVE SYSTEMS, LTD., Hitachinaka-Shi (JP)

( * ) Notice: Subject to any disclaimer, the term of this patent is extended or adjusted under 35 U.S.C. 154(b) by 70 days.

(21) Appl. No.: 14/628,814

(22) Filed: Feb. 23, 2015

(65) Prior Publication Data

US 2015/0252803 A1 Sep. 10, 2015

(30) Foreign Application Priority Data

Mar. 10, 2014 (JP) ..... 2014-045813

(51) Int. Cl.
*F04C 14/22* (2006.01)
*F04C 2/344* (2006.01)
(Continued)

(52) U.S. Cl.
CPC ..... *F04C 14/226* (2013.01); *F01M 1/02* (2013.01); *F01M 1/16* (2013.01); *F04C 2/344* (2013.01); *F04C 2/3442* (2013.01); *F04C 15/008* (2013.01); *F01M 2001/0238* (2013.01); *F01M 2001/0246* (2013.01); *F04C 2270/185* (2013.01)

(58) Field of Classification Search
CPC F04C 14/226; F04C 14/223; F04C 2270/185; F04C 2/344; F04C 14/22; F04C 14/24; F04C 14/18; F04C 28/18; F04C 28/22; F01M 1/16; F01M 2001/0246; F01M 2001/0238; F01C 20/22; F01C 20/18
See application file for complete search history.

(56) References Cited

U.S. PATENT DOCUMENTS 5,690,479 A * 11/1997 Lehmann ..... F01M 1/02 418/26
7,614,858 B2 * 11/2009 Tanasuca ..... F01C 21/0827 418/24

(Continued)

FOREIGN PATENT DOCUMENTS

JP 2010-209718 A 9/2010

*Primary Examiner* — Mark A Laurenzi
*Assistant Examiner* — Xiaoting Hu
(74) *Attorney, Agent, or Firm* — Foley & Lardner LLP

(57) ABSTRACT

A variable displacement pump includes a variable mechanism configured to change a volume-variation rate of each pump chamber by movement of a movable member; a biasing mechanism provided to bias the movable member in a direction that increases the volume-variation rate; at least one reduction-side control oil chamber to which oil is supplied from a discharge portion such that the reduction-side control oil chamber applies force to the movable member in a direction that reduces the volume-variation rate; at least one increase-side control oil chamber to which oil is supplied from the discharge portion such that the increase-side control oil chamber applies force to the movable member in the direction that increases the volume-variation rate; and a control mechanism configured to control a oil quantity which is supplied to each control oil chamber. The total number of the control oil chambers is three or more.

10 Claims, 22 Drawing Sheets

(51) Int. Cl.

| | |
|---|---|
| ***F01M 1/16*** | (2006.01) |
| ***F01M 1/02*** | (2006.01) |
| ***F04C 15/00*** | (2006.01) |

(56) References Cited

U.S. PATENT DOCUMENTS 8,011,908 B2 * 9/2011 Williamson ..... F04C 14/226 417/220
8,047,822 B2 * 11/2011 Shulver ..... F01M 1/16 417/220
8,057,201 B2 * 11/2011 Shulver ..... F04C 2/3442 417/220
8,613,610 B2 * 12/2013 Saga ..... F04C 2/3442 418/24
9,109,597 B2 * 8/2015 Bowing ..... F04C 2/344
2007/0224067 A1 * 9/2007 Arnold ..... F04C 2/344 418/26
2008/0107554 A1 * 5/2008 Shulver ..... F04C 2/102 418/26
2008/0247894 A1 * 10/2008 Lutoslawski ..... F04C 2/3442 418/27
2009/0022612 A1 * 1/2009 Williamson ..... F04C 2/04 418/24
2010/0028171 A1 * 2/2010 Shulver ..... F01M 1/16 417/307
2010/0221126 A1 * 9/2010 Tanasuca ..... F04C 14/226 417/218
2010/0226799 A1 * 9/2010 Watanabe ..... F04C 14/223 417/364
2010/0232989 A1 * 9/2010 Watanabe ..... F04C 14/226 417/364
2011/0189043 A1 * 8/2011 Watanabe ..... F04C 15/06 418/133
2011/0194967 A1 * 8/2011 Watanabe ..... F04C 14/226 418/138
2013/0164162 A1 * 6/2013 Saga ..... F04C 14/226 418/24
2013/0164163 A1 * 6/2013 Ohnishi ..... F04C 2/344 418/27
2014/0072456 A1 * 3/2014 Watanabe ..... F04B 17/003 417/218
2014/0147323 A1 * 5/2014 Watanabe ..... F04C 2/3442 418/27
2014/0219847 A1 * 8/2014 Watanabe ..... F04C 2/3442 418/24
2015/0020759 A1 * 1/2015 Watanabe ..... F04C 2/3442 123/90.15
2015/0030485 A1 * 1/2015 Cadeddu ..... F04C 14/223 418/1
2015/0218983 A1 * 8/2015 Watanabe ..... F04C 2/3442 210/130

* cited by examiner

VARIABLE DISPLACEMENT PUMP

BACKGROUND OF THE INVENTION

The present invention relates to a variable displacement pump adapted to supply working fluid.

U.S. Patent Application Publication No. 2010/226799 (corresponding to Japanese Patent Application Publication No. 2010-209718) discloses a previously-proposed variable displacement pump.

The variable displacement pump disclosed in this patent application is a so-called vane pump. In this technique, the variable displacement pump includes a first control oil chamber, a second control oil chamber and an electromagnetic changeover valve. The first control oil chamber and the second control oil chamber are formed radially outside a cam ring and separated from each other. The first control oil chamber receives a pump discharge pressure and thereby applies force to the cam ring in a direction that reduces an eccentricity amount of the cam ring whereas the second control oil chamber receives the pump discharge pressure and thereby applies force to the cam ring in a direction that increases the eccentricity amount of the cam ring. The electromagnetic changeover valve selectively supplies or discharges the pump discharge pressure to/from the second control oil chamber by ON-OFF control. That is, the pump discharge pressure is controlled to attain a low-pressure characteristic and a high-pressure characteristic by controllably increasing and reducing the eccentricity amount of the cam ring in accordance with rotational speed of the pump.

SUMMARY OF THE INVENTION

However, in the case of the previously-proposed variable displacement pump, only two control oil chambers which control the movement of the cam ring are provided. Hence, the pump discharge pressure attains only two levels of the low-pressure characteristic and the high-pressure characteristic as mentioned above. For example, the low-pressure characteristic is required for driving a valve-timing control device, and the high-pressure characteristic is required for supplying oil to a bearing for a crankshaft.

Accordingly, in the case of the previously-proposed variable displacement pump, more than two required hydraulic-pressure characteristics cannot be attained. For example, a hydraulic-pressure characteristic required for an oil jet for spraying oil to a piston cannot be satisfied.

It is therefore an object of the present invention to provide a variable displacement pump devised to attain at least three of required hydraulic-pressure characteristics.

According to one aspect of the present invention, there is provided a variable displacement pump comprising: pump constituting members configured to suck oil from a suction portion and discharge the oil to a discharge portion by volume variation of each of a plurality of pump chambers of the pump constituting members; a variable mechanism configured to change a rate of the volume variation of each of the plurality of pump chambers by movement of a movable member of the variable mechanism; a biasing mechanism provided to have a set load and to bias the movable member in a direction that increases the rate of the volume variation of each of the plurality of pump chambers; a reduction-side oil chamber group including at least one control oil chamber to which the oil is supplied from the discharge portion such that the at least one control oil chamber of the reduction-side oil chamber group applies force to the movable member in a direction that reduces the rate of the volume variation of each of the plurality of pump chambers; an increase-side oil chamber group including at least one control oil chamber to which the oil is supplied from the discharge portion such that the at least one control oil chamber of the increase-side oil chamber group applies force to the movable member in the direction that increases the rate of the volume variation of each of the plurality of pump chambers; and a control mechanism configured to control a quantity of the oil which is supplied to each of the at least one control oil chamber of the reduction-side oil chamber group and the at least one control oil chamber of the increase-side oil chamber group, wherein a total number of the at least one control oil chamber of the reduction-side oil chamber group and the at least one control oil chamber of the increase-side oil chamber group is larger than or equal to three.

According to another aspect of the present invention, there is provided a variable displacement pump comprising: pump constituting members configured to be drivingly rotated by an internal combustion engine such that oil is sucked from a suction portion and discharged to a discharge portion by volume variation of each of a plurality of pump chambers of the pump constituting members; a variable mechanism configured to change a rate of the volume variation of each of the plurality of pump chambers by movement of a movable member of the variable mechanism; a biasing mechanism provided to have a set load and to bias the movable member in a direction that increases the rate of the volume variation of each of the plurality of pump chambers; a reduction-side oil chamber group including at least one control oil chamber to which the oil is supplied from the discharge portion such that the at least one control oil chamber of the reduction-side oil chamber group applies force to the movable member in a direction that reduces the rate of the volume variation of each of the plurality of pump chambers; an increase-side oil chamber group including at least one control oil chamber to which the oil is supplied from the discharge portion such that the at least one control oil chamber of the increase-side oil chamber group applies force to the movable member in the direction that increases the rate of the volume variation of each of the plurality of pump chambers; and a control mechanism configured to control a quantity of the oil which is supplied to each of the at least one control oil chamber of the reduction-side oil chamber group and the at least one control oil chamber of the increase-side oil chamber group, wherein a pressure of the discharged oil is controlled in three stages or more with respect to a rotational speed of the internal combustion engine such that the pressure of the discharged oil is increased in a stepwise manner with a rise of the rotational speed of the internal combustion engine.

According to still another aspect of the present invention, there is provided a variable displacement pump comprising: a rotor configured to be drivingly rotated by an internal combustion engine; a plurality of vanes movable out from and into slits of an outer circumferential portion of the rotor; a cam ring provided to give an eccentricity between a rotation center of the rotor and a center of an inner diameter of the cam ring, wherein the rotor and the plurality of vanes are accommodated in the cam ring such that a plurality of pump chambers are separately formed by the cam ring, the rotor and the plurality of vanes, wherein the cam ring is configured to move to vary an amount of the eccentricity and thereby to vary a displacement of the variable displacement pump; a suction portion open to a part of the plurality of pump chambers whose volume is increased by a rotation of the rotor; a discharge portion open to a part of the plurality of pump chambers whose volume is reduced by the rotation of the rotor; a biasing member provided to have a set load and to bias the cam ring in a direction that increases the eccentricity amount; a reduction-side oil chamber group including at least one control oil chamber to which a discharge pressure is introduced from the discharge portion such that the at least one control oil chamber of the reduction-side oil chamber group applies force to the cam ring in a direction that reduces the eccentricity amount against a biasing force of the biasing member; an increase-side oil chamber group including at least one control oil chamber to which the discharge pressure is introduced from the discharge portion such that the at least one control oil chamber of the increase-side oil chamber group cooperates with the biasing member to apply force to the cam ring in the direction that increases the eccentricity amount; and a control mechanism configured to controllably introduce the discharge pressure to each of the at least one control oil chamber of the reduction-side oil chamber group and the at least one control oil chamber of the increase-side oil chamber group, wherein a total number of the at least one control oil chamber of the reduction-side oil chamber group and the at least one control oil chamber of the increase-side oil chamber group is larger than or equal to three.

The other objects and features of this invention will become understood from the following description with reference to the accompanying drawings.

DETAILED DESCRIPTION OF THE INVENTION

Figure 1:
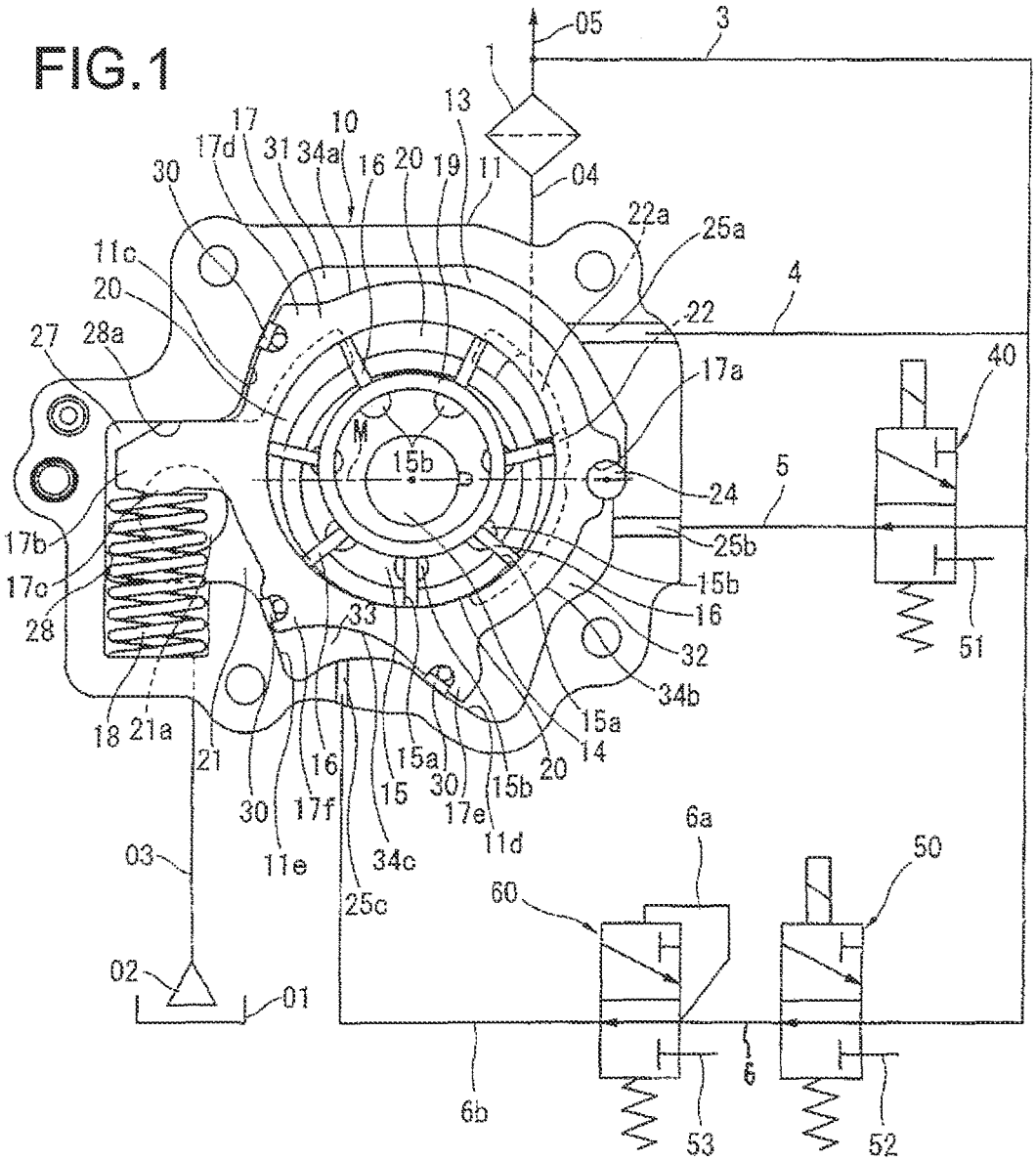
FIG. 1 is a schematic view showing an oil pump and a hydraulic circuit in a variable displacement pump of a first embodiment according to the present invention, under the condition that a cam ring of the oil pump has a maximum eccentricity amount.

Reference will hereinafter be made to the drawings in order to facilitate a better understanding of the present invention. Respective embodiments of variable displacement pump according to the present invention will be explained below in detail, referring to the drawings. The following respective embodiments will give examples in a case that the variable displacement pump functions as a drive source for a valve-timing control device (VTC) provided for varying valve timings of an internal combustion engine of a vehicle, and supplies lubricating oil to sliding portions of the engine (particularly to a sliding portion between a piston and a cylinder bore) by use of an oil jet, and supplies lubricating oil to a bearing for a crankshaft.

[First Embodiment]

FIG. 1 shows an oil-pump portion and a hydraulic circuit in the variable displacement pump of a first embodiment according to the present invention. An oil pan 01 retains oil. The oil pump 10 rotates by rotary drive force derived from the crankshaft of the internal combustion engine, and thereby sucks oil from the oil pan 01 through a strainer 02 and a suction passage 03 and discharges oil through a discharge passage (discharge portion) 04 to a main oil gallery 05 of the engine.

From the main oil gallery 05, oil is supplied to the sliding portions of the engine (e.g., the oil jet for spraying cooling oil to the piston), the valve-timing control device, and the bearing of the crankshaft. An oil filter 1 is disposed in the main oil gallery 05 at a location downstream of the discharge passage 04. The oil filter 1 collects foreign substances which exist within the flowing oil.

A control passage 3 branches off from the main oil gallery 05 at a location downstream of the oil filter 1. That is, the main oil gallery 05 is connected with an upstream end of the control passage 3 in a branched manner. A downstream side of the control passage 3 directly communicates with a supply passage 4 connected with an after-mentioned first control oil chamber 31. Moreover, the downstream side of the control passage 3 communicates through a first electromagnetic changeover valve 40 with a first supply/drain passage 5 connected with an after-mentioned second control oil chamber 32. Furthermore, the downstream side of the control passage 3 communicates through a second electromagnetic changeover valve 50 with a second supply/drain passage 6. The second supply/drain passage 6 communicates through a pilot valve 60 with an after-mentioned third control oil chamber 33. The first electromagnetic changeover valve 40, the second electromagnetic changeover valve 50 and the pilot valve 60 constitute a control mechanism according to the present invention.

The first electromagnetic changeover valve 40 is controlled between ON (energized) state and OFF (not-energized) state by a control unit (not shown). Accordingly, the first electromagnetic changeover valve 40 causes the control passage 3 to communicate with the first supply/drain passage 5 or causes the first supply/drain passage 5 to communicate with a drain passage 51. Also the second electromagnetic changeover valve 50 is controlled between ON (energized) state and OFF (not-energized) state by the control unit. Accordingly, the second electromagnetic changeover valve 50 causes the control passage 3 to communicate with the second supply/drain passage 6 or causes the second supply/drain passage 6 to communicate with a drain passage 52. On the other hand, the pilot valve 60 blocks or opens the second supply/drain passage 6 in accordance with a discharge pressure applied through the second electromagnetic changeover valve 50. Concrete configurations of the first electromagnetic changeover valve 40, the second electromagnetic changeover valve 50 and the pilot valve 60 will be explained later.

Figure 2:
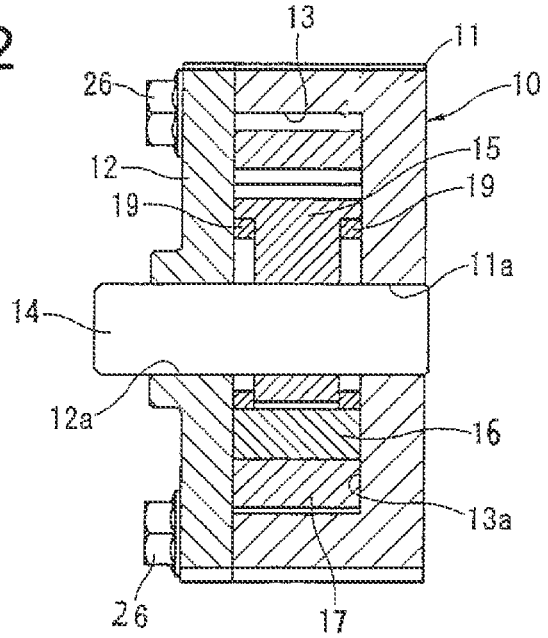
FIG. 2 is a vertical sectional view of the oil pump in the first embodiment.
Figure 3:
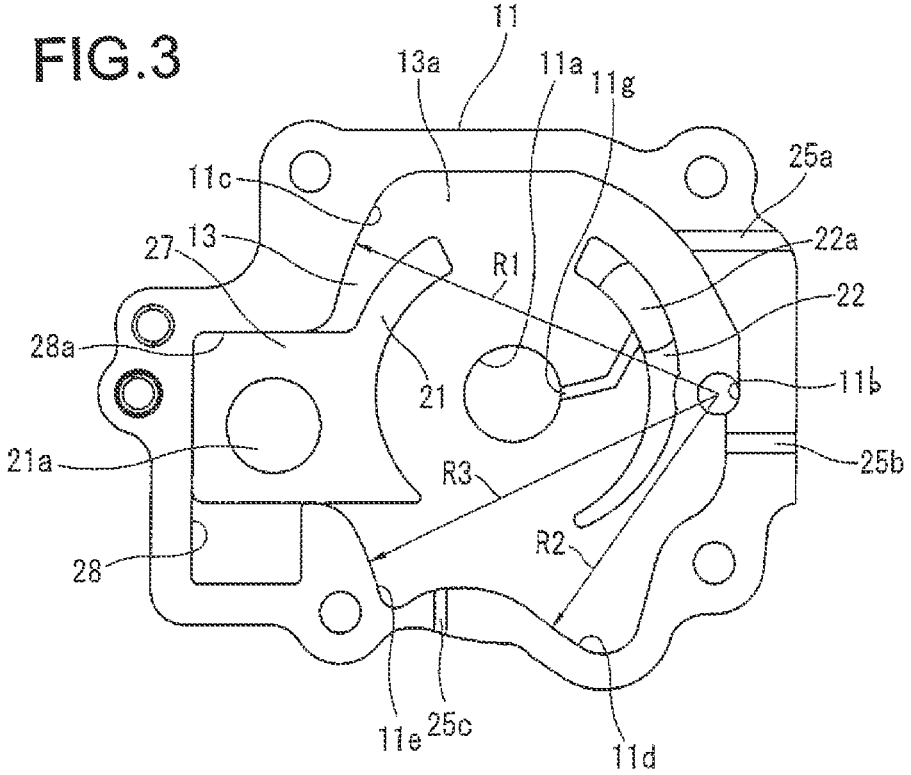
FIG. 3 is a front view of a pump body of the oil pump in the first embodiment.

The oil pump 10 is provided at a front end portion of a cylinder block (not shown) of the internal combustion engine. As shown in FIGS. 1 to 3, the oil pump 10 includes a pump body 11, a cover member 12, a drive shaft 14, a rotor 15, a plurality of vanes 16, a cam ring 17, a spring 18, and a pair of ring members 19. The pump body 11 is formed in a U-shape in cross section as viewed in a direction perpendicular to the drive shaft 14 such that one axial end of the pump body 11 is open. Thus, a pump accommodation chamber 13 which is a cylindrical-column space is provided inside the pump body 11. The cover member 12 covers or closes the one axial end (opening) of the pump body 11. The drive shaft 14 passes through an approximately center portion of the pump accommodation chamber 13, and is rotatably supported by the pump body 11 and the cover member 12. The drive shaft 14 is drivingly rotated by the crankshaft of the engine. The rotor 15 is rotatably accommodated inside the pump accommodation chamber 13, and a central portion of the rotor 15 is fixedly combined with the drive shaft 14. A plurality of slits 15*a* are formed by radially cutting (notching) an outer circumferential portion of the rotor 15. The plurality of vanes 16 are received respectively by the plurality of slits 15*a* of the rotor 15 to be able to rise and fall relative to an outer circumferential surface of the rotor 15. That is, each of the vanes 16 is movable out from and into the outer circumferential portion of the rotor 15. The cam ring 17 is disposed radially outside the plurality of vanes 16 such that the cam ring 17 is able to swing (move) to give eccentricity between a center of inner circumferential surface of the cam ring 17 and a rotation center of the rotor 15. The cam ring 17 cooperates with the rotor 15 and the plurality of vanes 16 to separately form a plurality of pump chambers 20. That is, each of the plurality of pump chambers 20 is formed by the inner circumferential surface of the cam ring 17, adjacent two of the plurality of vanes 16 and the outer circumferential surface of the rotor 15. The spring 18 is accommodated in the pump body 11, and functions as a biasing member which always biases the cam ring 17 in a direction that increases an eccentricity amount of the cam ring 17 relative to the rotation center of the rotor 15. Each of the pair of ring members 19 has a diameter smaller than a diameter of axially-both side portions of the rotor 15. The pair of ring members 19 are disposed radially inside the axially-both side portions of the rotor 15 such that the pair of ring members 19 are slidable on the rotor 15. It is noted that the drive shaft 14, the rotor 15, the plurality of vanes 16 correspond to pump constituting members according to the present invention.

The pump body 11 is integrally formed of aluminum alloy, and includes a bottom wall (axially one end wall) constituting a bottom surface 13*a* of the pump accommodation chamber 13. As shown in FIGS. 2 and 3, the bottom wall (axially one end wall) of the pump body 11 is formed with a bearing hole (shaft-receiving hole) 11*a* axially passing through a substantially center of the bottom surface 13*a*. The bearing hole 11*a* rotatably supports one end portion of the drive shaft 14. Moreover, at a predetermined portion of an inner circumferential wall of the pump accommodation chamber 13 which constitutes an inside surface of the pump body 11, the supporting groove 11*b* is formed in the inner circumferential wall. A pivot pin 24 is inserted and fixed to the supporting groove 11*b* and thereby swingably supports the cam ring 17. As shown in FIG. 3, a downstream end of a passage groove 11*g* is open to the bearing hole 11*a*. Oil is supplied to the passage groove 11*g* from an after-mentioned discharge port 22.

Moreover, as shown in FIG. 1, a first sealing slide-contact surface 11*c*, a second sealing slide-contact surface 11*d* and a third sealing slide-contact surface 11*e* are formed in the inner circumferential wall of the pump accommodation chamber 13. After-mentioned three seal members 30 which are provided in an outer circumferential portion of the cam ring 17 respectively slide in contact with the first sealing slide-contact surface 11*c*, the second sealing slide-contact surface 11*d* and the third sealing slide-contact surface 11*e*. The second sealing slide-contact surface 11*d* and the third sealing slide-contact surface 11*e* are located in a lower half side of FIG. 1 (i.e., in the side of spring 18) with respect to an imaginary line M connecting a center of the bearing hole 11*a* with a center of the supporting groove 11*b* (Hereinafter, this imaginary line M will be referred to as "cam-ring reference line"), whereas the first sealing slide-contact surface 11*c* is located in an upper half side with respect to the imaginary line M.

Moreover, as shown in FIGS. 2 and 3, in the bottom surface 13*a* of the pump accommodation chamber 13, a suction port 21 and a discharge port 22 are formed as recesses so as to face each other through the bearing hole 11*a*. That is, the suction port 21 and the discharge port 22 are located in an outer periphery of the bearing hole 11*a*, and the bearing hole 11*a* is located between the suction port 21 and the discharge port 22 in a plane perpendicular to the axial direction. The suction port 21 is formed in a concave shape, and is open to a region (hereinafter, referred to as "suction region") in which an internal volume of each pump chamber 20 becomes larger with a pumping action of the pump constituting members. The discharge port 22 is formed by cutting (notching) the bottom surface 13*a* in a substantially arc concave shape, and is open to a region (hereinafter, referred to as "discharge region") in which the internal volume of each pump chamber 20 becomes smaller with the pumping action of the pump constituting members.

A suction hole 21*a* is formed to communicate with one end side of the suction port 21 and extend to (overlap with) an after-mentioned spring receiving chamber 28 as viewed in the axial direction of the oil pump 10. The suction hole 21*a* passes through the bottom wall of the pump body 11 to an external of the pump body 11. By such a structure, lubricating oil retained in the oil pan 01 is sucked through the suction passage 03, the suction hole 21*a* and the suction port 21 to the pump chambers 20 located in the suction region, by means of negative pressure caused by the pumping action of the pump constituting members.

A discharge hole 22*a* is formed to communicate with the discharge port 22 at an upper location of FIG. 3 (i.e. in the upper half side with respect to the imaginary line M). The discharge hole 22*a* passes through the bottom wall of the pump body 11 and communicates through the discharge passage 04 with the main oil gallery 05.

By such a structure, oil pressurized and discharged from the pump chambers 20 located in the discharge region by the pumping action of the pump constituting members is supplied through the discharge port 22 and the discharge hole 22*a* to the main oil gallery 05. Thus, oil is supplied to the respective sliding portions inside the engine, the valve-timing control device and the like.

As shown in FIG. 2, whole of the cover member 12 is formed substantially in a plate shape. An outside portion of the cover member 12 includes a cylindrical (tubular) portion at a location corresponding to the bearing hole 11*a* of the pump body 11. The cylindrical portion of the cover member 12 is formed with a bearing hole (shaft-receiving hole) 12*a* which defines an inner circumferential surface of the cylindrical portion of the cover member 12. The bearing hole 12*a* axially passes through the cover member 12 and rotatably supports another end portion of the drive shaft 14. The cover member 12 is attached to a surface of the axial end (opening) of the pump body 11 by a plurality of bolts 26.

An inside surface of the cover member 12 is substantially flat in this example. However, the inside surface of the cover member 12 can be formed with the suction port 21 and the discharge port 22, in the same manner as the bottom surface of the pump body 11.

The drive shaft 14 rotates the rotor 15 in a clockwise direction of FIG. 1 by rotary force transmitted from the crankshaft.

As shown in FIG. 1, the rotor 15 is formed with the seven slits 15*a* each extending from a center side of the rotor 15 to a radially outer side of the rotor 15. Also, the rotor 15 is formed with a plurality of backpressure chambers 15*b* each located at an inner base end portion of the corresponding slit 15*a*. Each backpressure chamber 15*b* is formed substantially in a circular shape in cross section taken by a plane perpendicular to the axial direction. The oil discharged into the discharge port 22 is introduced into the backpressure chambers 15*b*. Accordingly, each vane 16 is pushed in the radially outer direction by a hydraulic pressure of the backpressure chamber 15*b* and a centrifugal force caused by the rotation of the rotor 15.

A tip surface of each vane 16 slides in contact with the inner circumferential surface of the cam ring 17, and an inner edge surface of a base end portion of each vane 16 slides in contact with outer circumferential surfaces of the respective ring members 19. Hence, even when an engine speed is low and the centrifugal force and the hydraulic pressure of the backpressure chambers 15*b* are low, each pump chamber 20 is liquid-tightly separated by the outer circumferential surface of the rotor 15, inside surfaces of adjacent vanes 16, the inner circumferential surface of the cam ring 17, the bottom surface 13*a* of the pump accommodation chamber 13 (the pump body 11 as a lateral wall), and the inside surface of the cover member 12.

The cam ring 17 is made of sintered metal and formed integrally in an annular shape. A predetermined part of the outer circumferential portion of the cam ring 17 is formed with a groove-shaped (recessed) pivot portion 17*a* whole of which protrudes along the axial direction. The groove-shaped pivot portion 17*a* is formed to be cut in a substantially circular-arc shape in cross section, and is fitted over the pivot pin 24 so that a swing fulcrum is formed for varying the eccentricity amount of the cam ring 17. A part of the outer circumferential portion of the cam ring 17 which is located opposite to the pivot portion 17*a* with respect to the center of the cam ring 17 is formed with an arm portion 17*b* protruding in the radial direction of the cam ring 17. (i.e., the center of the cam ring 17 is located between the groove-shaped pivot portion 17*a* and the arm portion 17*b*) The arm portion 17*b* is linked to the spring 18.

The spring receiving chamber 28 and a communicating portion 27 are provided in the pump body 11 at a location opposite to the supporting groove 11*b* with respect to the drive shaft 14. The spring receiving chamber 28 communicates with the pump accommodation chamber 13 through the communicating portion 27. The spring 18 is received in the spring receiving chamber 28.

The arm portion 17*b* extends through the communicating portion 27 into the spring receiving chamber 28. The spring 18 is elastically held between a lower surface of a tip portion of the arm portion 17*b* and a bottom surface of the spring receiving chamber 28 to have a predetermined set load W. The lower surface of the tip portion of the arm portion 17*b* is formed with a supporting protrusion 17*c* which protrudes toward the spring 18. The supporting protrusion 17*c* is formed in a substantially circular-arc shape to be engaged with an inner circumferential portion of the spring 18. Accordingly, the supporting protrusion 17*c* supports one end of the spring 18.

Therefore, the spring 18 always biases the cam ring 17 through the arm portion 17*b* in a direction that increases the eccentricity amount of the cam ring 17 (in the clockwise direction of FIG. 1) by elastic force based on the spring load W. Hence, when the oil pump 10 is not in operation, an upper surface of the arm portion 17*b* of the cam ring 17 is pressed against a stopper surface 28*a* of the pump body 11 by the elastic force of the spring 18. At this time, the eccentricity amount of the cam ring 17 relative to the rotation center of the rotor 15 is maximized and then maintained. It is noted that the stopper surface 28*a* is formed in a lower surface of an upper wall of the spring receiving chamber 28 (as viewed in FIG. 1).

The outer circumferential portion of the cam ring 17 is formed with three first to third seal-constituting portions 17*d*, 17*e* and 17*f*. Each of the first to third seal-constituting portions 17*d*, 17*e* and 17*f* is formed to protrude or bulge in the radial direction of the cam ring 17. The first seal-constituting portion 17*d* includes a first sealing surface which is formed to face the first sealing slide-contact surface 11*c*. The second seal-constituting portion 17*e* includes a second sealing surface which is formed to face the second sealing slide-contact surface 11*d*. The third seal-constituting portion 17*f* includes a third sealing surface which is formed to face the third sealing slide-contact surface 11*e*. Each of the first to third seal-constituting portions 17*d*, 17*e* and 17*f* is formed in a substantially triangular shape in cross section taken by a plane perpendicular to the axial direction as shown in FIG. 1. The sealing surfaces of the first to third seal-constituting portions 17*d*, 17*e* and 17*f* are respectively formed with first to third seal retaining grooves by cutting or notching the sealing surfaces along the axial direction. Each of the first to third seal retaining grooves is formed in a substantially U-shape in cross section taken by the plane perpendicular to the axial direction as shown in FIG. 1. The three seal members 30 which respectively slide on the sealing slide-contact surfaces 11*c* to 11*e* at the time of eccentric swing of the cam ring 17 are received and held in the first to third seal retaining grooves.

As shown in FIG. 3, the first sealing slide-contact surface 11*c* is formed by a radius R1 about a center of the pivot portion 17*a*. That is, a distance between the center of the pivot portion 17*a* and the first sealing slide-contact surface 11*c* is equal to the radius R1. In the same manner, each of the second and third sealing slide-contact surfaces 11*d* and 11*e* is formed by a radius R2, R3 about the center of the pivot portion 17*a*. The first sealing surface of the first seal-constituting portion 17*d* is formed by a predetermined radius (about the center of the pivot portion 17*a*) slightly smaller than the radius R1 of the first sealing slide-contact surface 11*c*. In the same manner, each of the second and third sealing surfaces of the second and third seal-constituting portions 17*e* and 17*f* is formed by a predetermined radius slightly smaller than the radius R2, R3 of the corresponding sealing slide-contact surface 11*d*, 11*e*. Hence, a minute clearance is formed between the first sealing slide-contact surface 11*c* and the first sealing surface of the first seal-constituting portion 17*d*. In the same manner, a minute clearance is formed between each of the second and third sealing slide-contact surfaces 11*d* and 11*e* and the sealing surface of the corresponding seal-constituting portion 17*e*, 17*f*.

Each of the three seal members 30 is made of, for example, fluorine-series resin having a low frictional property, and is formed in a straightly-linear and narrow shape along the axial direction of the cam ring 17. The three seal members 30 are pressed to the sealing slide-contact surfaces 11*c* to 11*e* by elastic force of elastic members provided at bottom portions of the first to third seal retaining grooves. These elastic members are, for example, made of rubber. Accordingly, a favorable liquid tightness of the after-mentioned control oil chambers 31 to 33 is always ensured.

As shown in FIG. 1, the first control oil chamber 31, the second control oil chamber 32 and the third control oil chamber 33 are formed in a region radially outside the cam ring 17, i.e. between the outer circumferential surface of the cam ring 17 and an inner circumferential surface of the pump body 11. The first control oil chamber 31, the second control oil chamber 32 and the third control oil chamber 33 are separated from each other by the outer circumferential surface of the cam ring 17, the pivot portion 17*a*, the respective seal members 30 and the inside surface of the pump body 11. The first control oil chamber 31 is located above the pivot portion 17*a* (i.e., located in the upper half side with respect to the imaginary line M) whereas the second control oil chamber 32 and the third control oil chamber 33 are located below the pivot portion 17*a* (i.e., located in the lower half side with respect to the imaginary line M). That is, the pivot portion 17*a* is located between the first control oil chamber 31 and the combination of the second control oil chamber 32 ad the third control oil chamber 33.

A pump discharge pressure discharged into the discharge port 22 is always supplied through the main oil gallery 05, the control passage 3, the supply passage 4 and a first communication hole 25*a* to the first control oil chamber 31. The first communication hole 25*a* is formed in a lateral portion of the pump body 11. The first control oil chamber 31 faces a first pressure-receiving surface 34*a* which is a part of the outer circumferential surface of the cam ring 17. As shown in FIGS. 6 to 9, the first pressure-receiving surface 34*a* receives hydraulic pressure derived from the main oil gallery 05, and thereby gives a swinging force (moving force) in a direction that reduces the eccentricity amount of the cam ring 17 (i.e., in a counterclockwise direction of FIG. 1) against the biasing force of the spring 18.

That is, the first control oil chamber 31 constitutes a reduction-side oil chamber group. The first control oil chamber 31 constantly pushes the cam ring 17 through the first pressure-receiving surface 34*a* in the direction that brings the center of the cam ring 17 closer to the rotation center of the rotor 15, i.e. in the direction that reduces the eccentricity amount (toward a concentric state between the cam ring 17 and the rotor 15). Hence, the first control oil chamber 31 is provided for a displacement control of the cam ring 17 toward the concentric state.

The second control oil chamber 32 constitutes an increase-side oil chamber group. The discharge pressure of the control passage 3 is appropriately introduced through the first supply/drain passage 5 and a second communication hole 25*b* into the second control oil chamber 32 by means of ON/OFF operations of the first electromagnetic changeover valve 40. The second communication hole 25*b* is formed in the lateral portion of the pump body 11 so as to extend parallel to the first communication hole 25*a* and pass through the pump body 11.

The second control oil chamber 32 faces a second pressure-receiving surface 34*b* which is a part of the outer circumferential surface of the cam ring 17. The discharge pressure is applied to this second pressure-receiving surface 34*b*, and thereby gives assist force to the biasing force of the spring 18. Accordingly, (the discharge pressure of) the second control oil chamber 32 applies a swinging force (moving force) to the cam ring 17 in the direction that increases the eccentricity amount of the cam ring 17 (i.e., in the clockwise direction of FIG. 1).

The third control oil chamber 33 is located below the second control oil chamber 32 (as viewed in FIG. 1), i.e., located between the second control oil chamber 32 and the spring receiving chamber 28. The third control oil chamber 33 constitutes the increase-side oil chamber group. The discharge pressure of the control passage 3 is appropriately introduced through the second supply/drain passage 6, the pilot valve 60 and a third communication hole 25*c* into the third control oil chamber 33 by means of ON/OFF operations of the second electromagnetic changeover valve 50. The third communication hole 25*c* is formed in a lower portion of the pump body 11 so as to extend in an up-down direction as viewed in FIG. 1 (i.e., in the basing direction of the spring 18) and pass through the pump body 11.

The third control oil chamber 33 faces a third pressure-receiving surface 34*c* which is a part of the outer circumferential surface of the cam ring 17. The discharge pressure is applied to this third pressure-receiving surface 34*c*, and thereby gives assist force to the biasing force of the spring 18 in cooperation with the discharge pressure of the second pressure-receiving surface 34*b*. Accordingly, (the discharge pressure of) the third control oil chamber 33 applies a swinging force (moving force) to the cam ring 17 in the direction that increases the eccentricity amount of the cam ring 17 (i.e., in the clockwise direction of FIG. 1).

As shown in FIG. 1, an area (pressure-receiving area) of each of the second pressure-receiving surface 34*b* and the third pressure-receiving surface 34*c* is smaller than an area (pressure-receiving area) of the first pressure-receiving surface 34*a*. Total biasing force which is applied to the cam ring 17 in the direction that increases the eccentricity amount is given by a sum of the biasing force of the spring 18 and a biasing force based on internal pressures of the second control oil chamber 32 and the third control oil chamber 33. Total biasing force which is applied to the cam ring 17 in the direction that reduces the eccentricity amount is given based on internal pressure of the first control oil chamber 31. These total biasing forces which are applied in the both directions are balanced to satisfy a predetermined force relationship. Hence, as mentioned above, hydraulic pressures of the second control oil chamber 32 and the third control oil chamber 33 assist the biasing force of the spring 18. That is, the pump discharge pressures supplied to the second control oil chamber 32 and the third control oil chamber 33 through the first electromagnetic changeover valve 40, the second electromagnetic changeover valve 50 and the pilot valve 60 as needed basis act on the second pressure-receiving surface 34*b* and the third pressure-receiving surface 34*c* to appropriately assist the biasing force of the spring 18. Thus, the displacement (eccentricity amount) of the cam ring 17 is controlled.

Moreover, each of the first electromagnetic changeover valve 40 and the second electromagnetic changeover valve 50 operates based on exciting current derived from a control unit provided for controlling the internal combustion engine, according to an operating state of the engine. By the first electromagnetic changeover valve 40, the first supply/drain passage 5 is communicated with the control passage 3 or blocked from communicating with the control passage 3. By the second electromagnetic changeover valve 50, the second supply/drain passage 6 is communicated with the control passage 3 or blocked from communicating with the control passage 3.

Figure 4A:
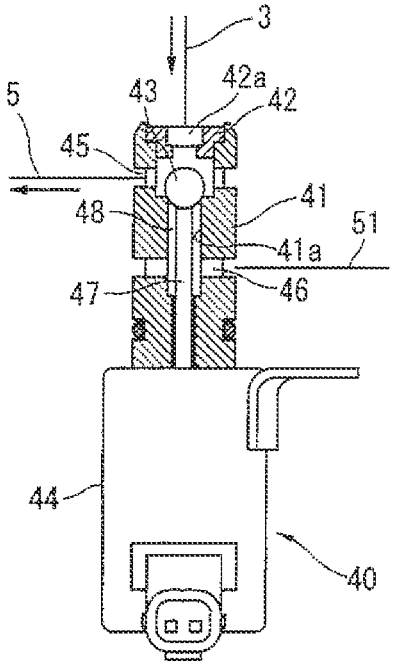
FIG. 4A is a vertical sectional view of an electromagnetic changeover valve in the first embodiment, and shows an open state thereof given by a ball valving element.
Figure 4B:
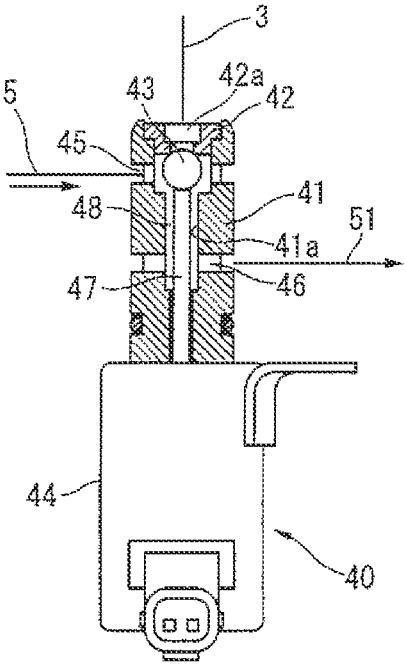
FIG. 4B is a vertical sectional view of the electromagnetic changeover valve, and shows a closed state thereof given by the ball valving element.

As shown in FIGS. 1, 4A and 4B, the first electromagnetic changeover valve 40 and the second electromagnetic changeover valve 50 are three-way changeover valves having the same structure as each other. Hence, for sake of simplicity, explanations about only the first electromagnetic changeover valve 40 will be given below.

The first electromagnetic changeover valve 40 mainly includes a valve body 41, a valve seat 42, a ball valving element 43 and a solenoid unit 44. The valve body 41 is forcibly inserted into a valve accommodation hole formed in a lateral wall of the cylinder block, so that the valve body 41 is fixed to the cylinder block. The valve body 41 is formed with a working hole 41*a* extending in an axial direction of the valve body 41 inside the valve body 41. The valve seat 42 is formed with a solenoid opening port 42*a* at a center portion of the valve seat 42, and forcibly inserted into a tip portion of the working hole 41*a*. This solenoid opening port 42*a* communicates with (i.e. is connected with) a downstream portion of the control passage 3. The ball valving element 43 is made from metal. The ball valving element 43 can be seated on and moved away from an inner side of the valve seat 42 so that the solenoid opening port 42*a* is opened and closed. The solenoid unit 44 is disposed on one end side of the valve body 41.

Moreover, the valve body 41 is formed with a communication port 45 which passes through the valve body 41 in a radial direction of the valve body 41. The communication port 45 is located in an upper end portion of peripheral wall of the valve body 41, and communicates with (i.e. is connected with) the first supply/drain passage 5. Moreover, the valve body 41 is formed with a drain port 46 which passes through the valve body 41 in the radial direction of the valve body 41. The drain port 46 is located in a lower end portion of the peripheral wall of the valve body 41, and communicates with the working hole 41*a*. That is, the drain port 46 is located between the communication port 45 and the solenoid unit 44.

The solenoid unit 44 includes an electromagnetic coil, a fixed iron-core, a moving iron-core (not shown), and a casing. The electromagnetic coil, the fixed iron-core, the moving iron-core and the like are accommodated and arranged in the casing. A pushrod 47 is provided at a tip portion of the moving iron-core. The pushrod 47 slides in the working hole 41*a* to have a predetermined clearance between the pushrod 47 and an inner circumferential surface of the working hole 41*a*, and thereby a tip of the pushrod 47 presses the ball valving element 43 and releases the press against the ball valving element 43.

A tubular passage 48 is formed between an outer circumferential surface of the pushrod 47 and the inner circumferential surface of the working hole 41*a*. The tubular passage 48 communicates or connects the communication port 45 with the drain port 46 as needed basis.

The control unit for the engine feeds and cuts electric-current to the electromagnetic coil to generate ON and OFF states of the electromagnetic coil.

That is, when the control unit outputs an OFF signal (non-energization signal) to the electromagnetic coil of the solenoid unit 44, the moving iron-core moves back by biasing force of a return spring (not shown) so that the press of the pushrod 47 against the ball valving element 43 is released. Thereby, the solenoid opening port 42*a* is opened as shown in FIG. 4A.

Figure 7:
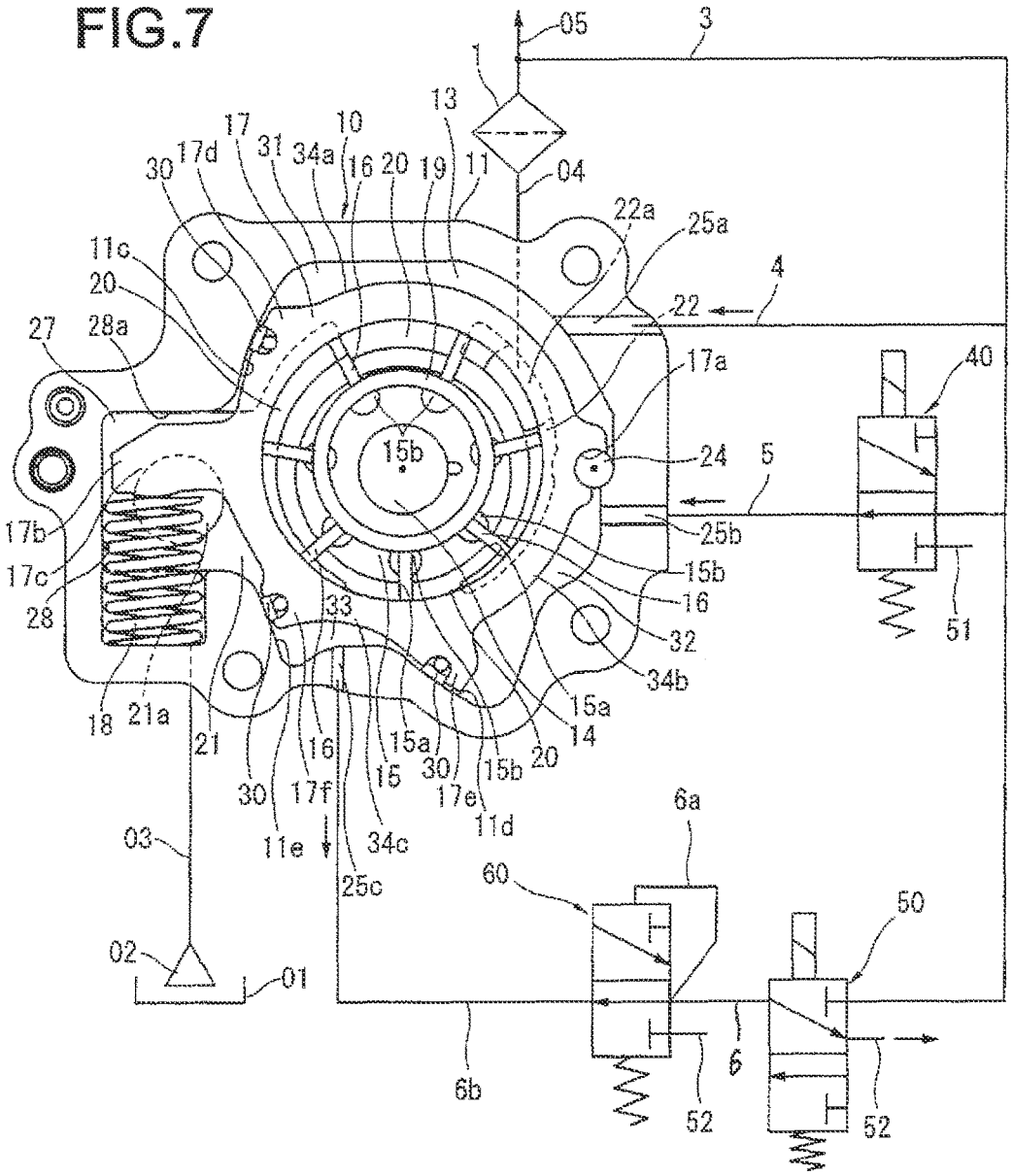
FIG. 7 is an explanatory view for operations of the variable displacement pump in the first embodiment.
Figure 8:
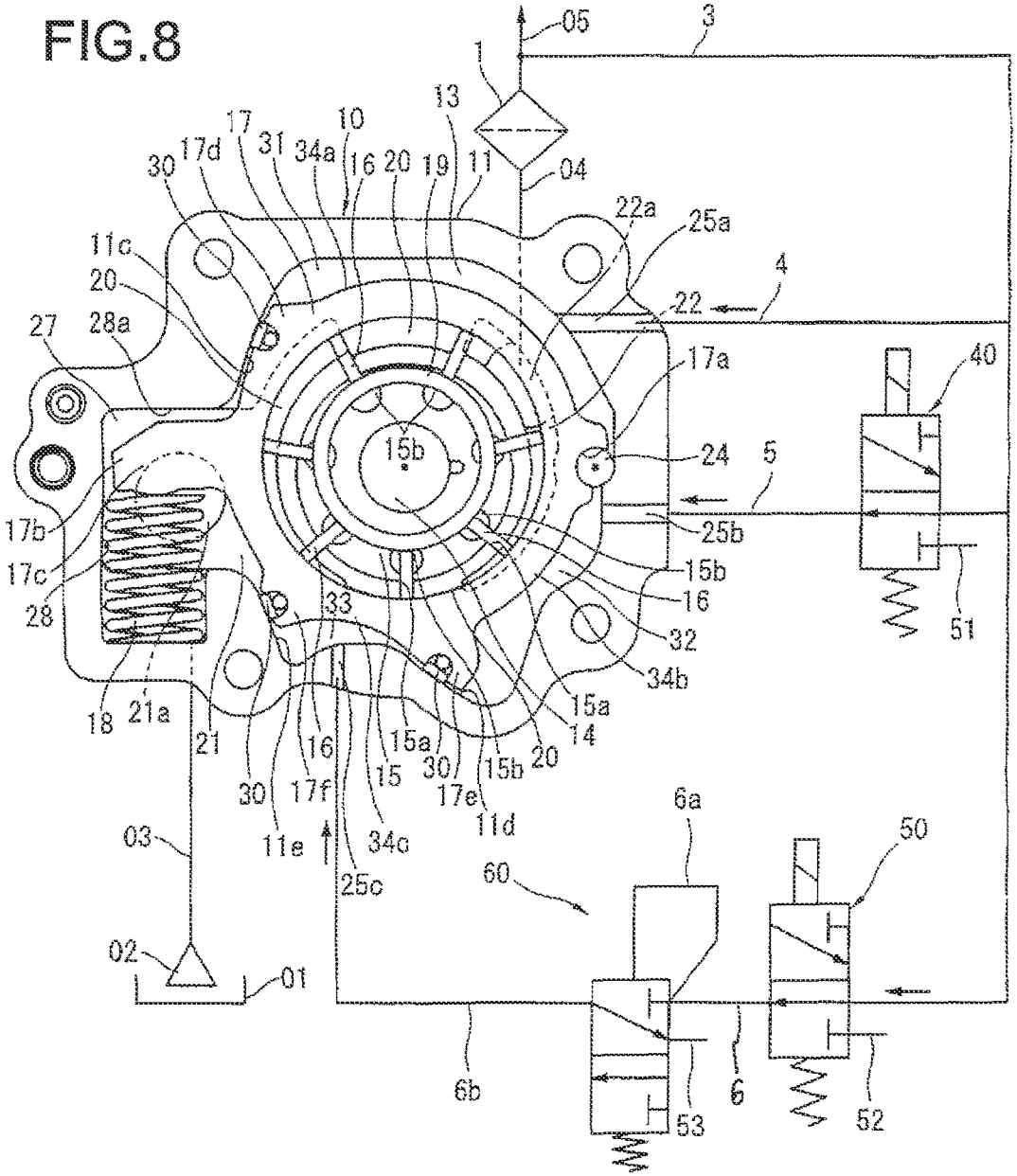
FIG. 8 is an explanatory view for operations of the variable displacement pump in the first embodiment.

At this time, as shown in FIGS. 7 and 8, the ball valving element 43 moves back (toward the solenoid unit 44) by the discharge pressure of the control passage 3, so that the control passage 3 is communicated with the first supply/drain passage 5 to supply hydraulic pressure to the second control oil chamber 32. At the same time, the ball valving element 43 blocks one end opening of the tubular passage 48 so that the communication port 45 is disconnected from the drain port 46, i.e. is blocked from communicating with the drain port 46.

Figure 6:
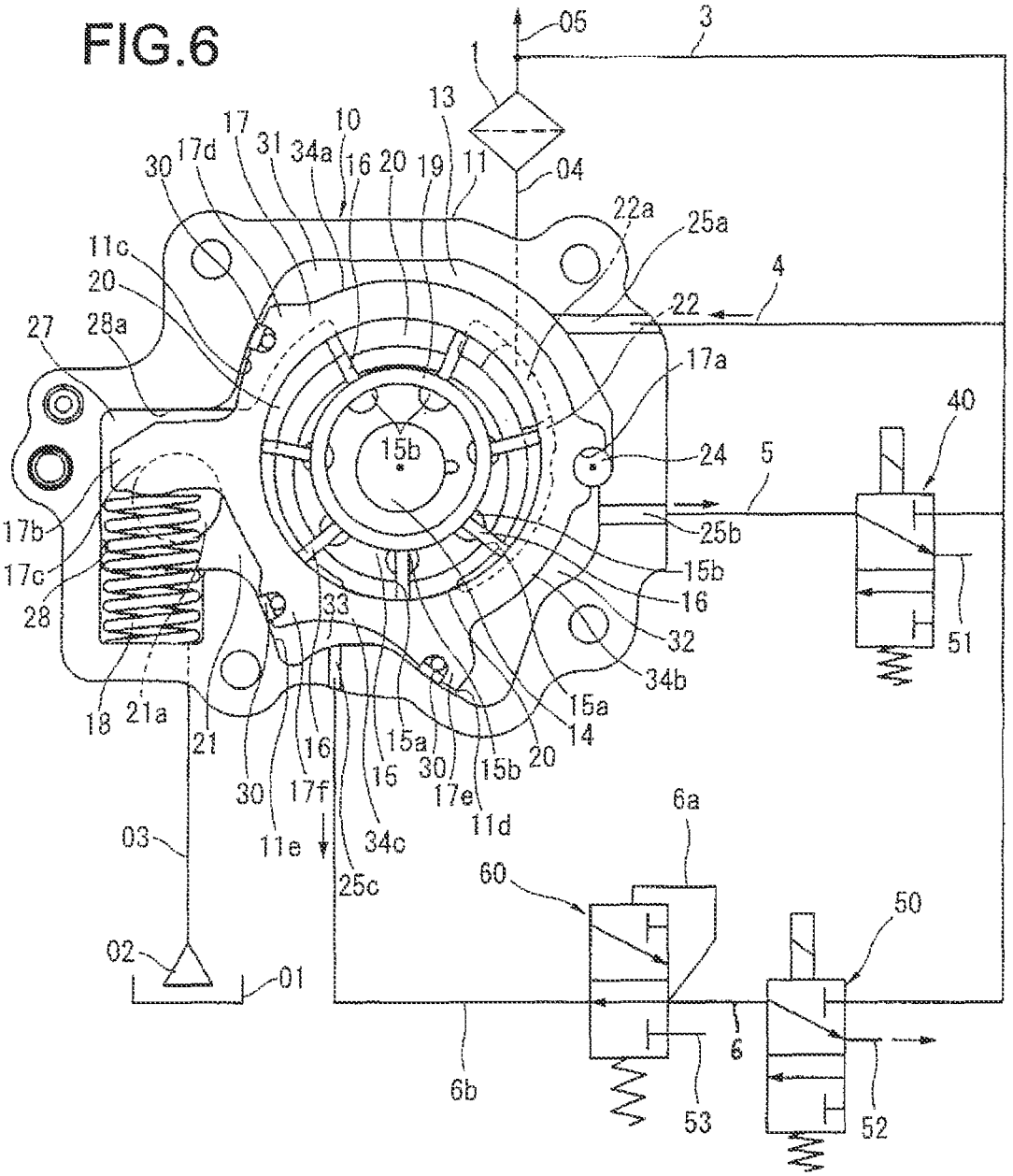
FIG. 6 is an explanatory view for operations of the variable displacement pump in the first embodiment.
Figure 9:
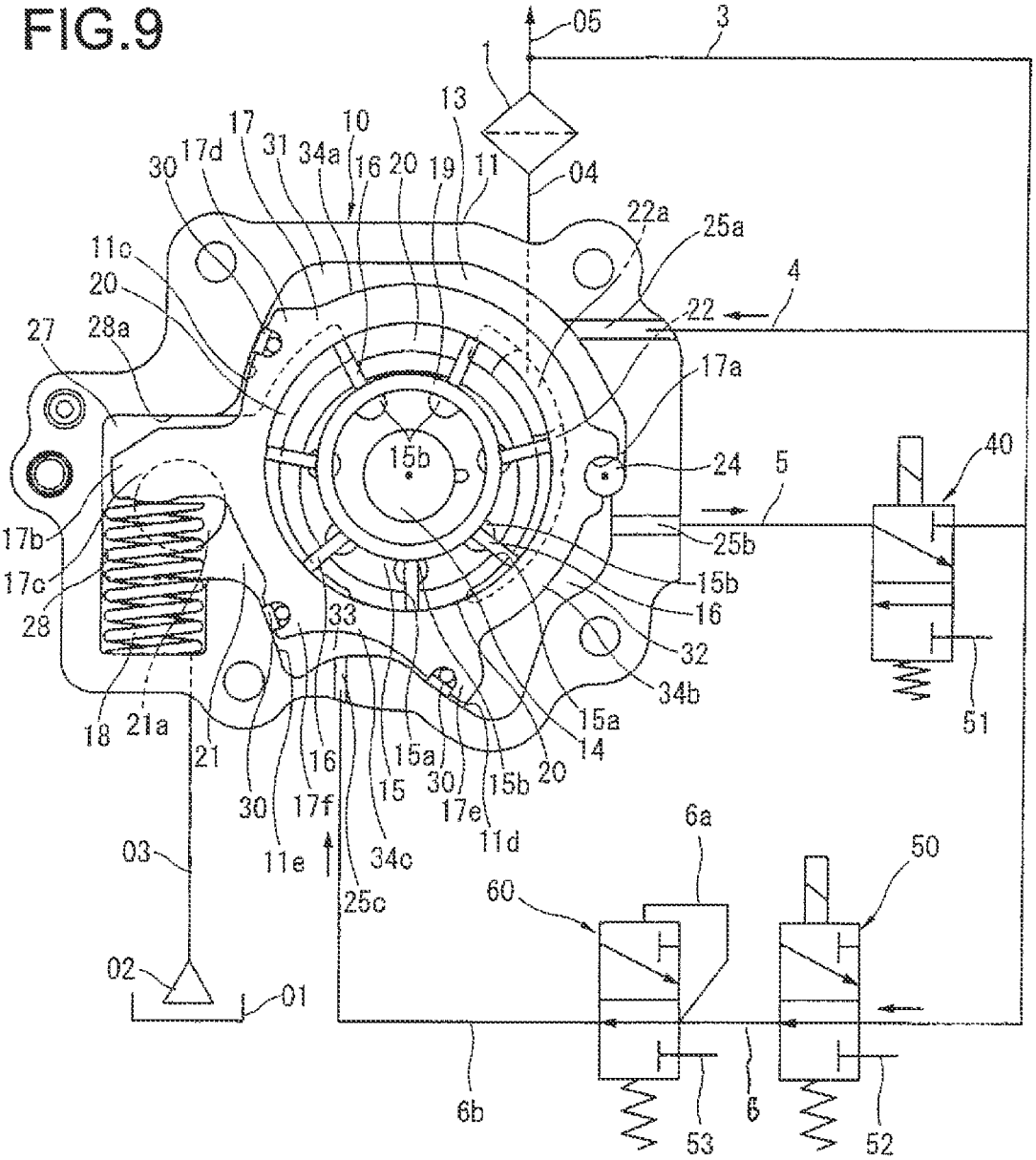
FIG. 9 is an explanatory view for operations of the variable displacement pump in the first embodiment.

On the other hand, when the control unit outputs an ON signal (energization signal) to the electromagnetic coil of the solenoid unit 44, the moving iron-core moves forward against the biasing force of the return spring so that the pushrod 47 presses the ball valving element 43 as shown in FIG. 4B. Thereby, the ball valving element 43 closes the solenoid opening port 42*a* so that the communication port 45 is communicated with the tubular passage 48. Accordingly, as shown in FIGS. 6 and 9, oil within the second control oil chamber 32 is drained through the first supply/drain passage 5, the communication port 45, the tubular passage 48, the drain port 46 and the drain passage 51 to the oil pan 01.

The second electromagnetic changeover valve 50 operates in the same manner as the first electromagnetic changeover valve 40. Hence, oil (hydraulic pressure) is supplied through the pilot valve 60 to the third control oil chamber 33, or drained from the third control oil chamber 33 to the drain passage 52, in the same manner as above.

The control unit detects a current engine operating state, from oil and water temperatures of the engine, the engine speed, an engine load and the like. Particularly, when the engine speed is lower than or equal to a predetermined level, the control unit outputs the ON signal (energization signal) to the electromagnetic coils of the first electromagnetic changeover valve 40 and the second electromagnetic changeover valve 50. On the other hand, when the engine speed is higher than the predetermined level, the control unit outputs the OFF signal (non-energization signal) to the electromagnetic coils of the first electromagnetic changeover valve 40 and the second electromagnetic changeover valve 50.

However, for example in a case that the engine load is in a high-load region, the control unit outputs the OFF signal to the electromagnetic coil (i.e., turns off the electromagnetic coil) to supply hydraulic pressure to the second control oil chamber 32 even when the engine speed is lower than or equal to the predetermined level.

Basically, the oil pump 10 achieves three patterns (kinds) of discharge-pressure characteristics in which the discharge pressure of the oil pump 10 is controlled to low, medium and high levels. The pattern in which the discharge pressure of the oil pump 10 is controlled to the low level is obtained by controlling the eccentricity amount of the cam ring 17 by use of the biasing force of the spring 18 and the internal pressure of the first control oil chamber 31 to which hydraulic pressure is supplied from the main oil gallery 05, and thereby controlling a variation of the internal volume of each pump chamber 20 which is generated with the pumping action. The patterns in which the discharge pressure of the oil pump 10 is controlled to the medium and high levels are obtained by controlling the eccentricity amount of the cam ring 17 by use of the biasing force of the spring 18 and the internal pressure of the first control oil chamber 31 in addition to the internal pressures of the second control oil chamber 32 and the third control oil chamber 33 which are produced by the first electromagnetic changeover valve 40 and the second electromagnetic changeover valve 50.

Figure 5A:
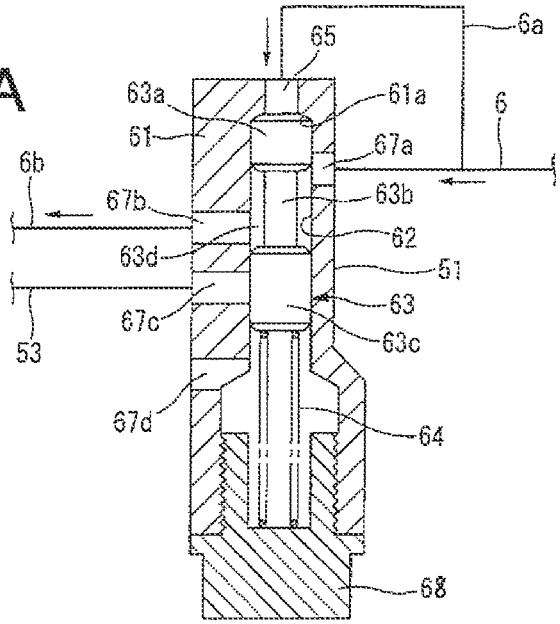
FIG. 5A is a vertical sectional view of a pilot valve in the first embodiment, and shows a state where a second supply/drain passage is communicated with a third control oil chamber by a spool valve.
Figure 5B:
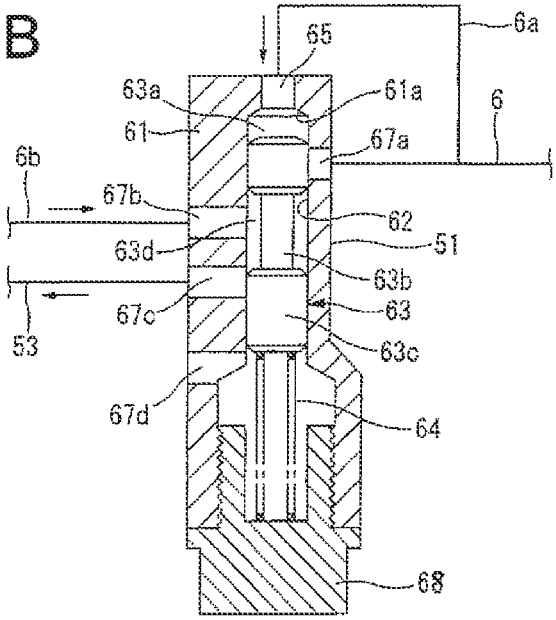
FIG. 5B is a vertical sectional view of the pilot valve, and shows a state where the third control oil chamber is communicated with a drain passage by the spool valve.

As shown in FIGS. 5A and 5B, the pilot valve 60 includes a cylindrical (tubular) valve body 61, a spool valve 63, a valve spring 64 and a plug 68. The spool valve 63 is provided in a sliding hole 62 formed inside the cylindrical valve body 61, and is able to slide in contact with a surface of the sliding hole 62. The plug 68 closes and seals a lower end opening (i.e. one end opening) of the valve body 61 under the condition that a spring load of the valve spring 64 biases the spool valve 63 in an upper direction as viewed in FIG. 5A (i.e. toward another end of the valve body 61).

Moreover, a pilot-pressure introduction port 65 is formed in (the another end of) the valve body 61, and is open to an axially upper end of the sliding hole 62 as viewed in FIG. 5A. The pilot-pressure introduction port 65 has a diameter smaller than a diameter of the sliding hole 62. A tapered surface 61*a* which is formed between the sliding hole 62 and the pilot-pressure introduction port 65 to connect these multilevel diameters with each other functions as a seating surface on which the spool valve 63 is seated. The spool valve 63 is seated on the tapered surface 61*a* when hydraulic pressure is not applied from the pilot-pressure introduction port 65 to the spool valve 63, because the spool valve 63 moves in the upper direction (i.e. toward the another end of the valve body 61) by the biasing force of the valve spring 64.

The pilot-pressure introduction port 65 of the valve body 61 communicates with (is open to) a pilot-pressure supply passage portion 6*a*. This pilot-pressure supply passage portion 6*a* is formed to branch off from the second supply/drain passage 6 at a location near the second electromagnetic changeover valve 50. Moreover, a peripheral wall of the valve body 61 has a portion which defines and faces the sliding hole 62. This portion of the peripheral wall is formed with a first supply/drain port 67*a*, a second supply/drain port 67*b* and a drain port 67*c* each of which passes through the peripheral wall of the valve body 61 in a radial direction of the valve body 61. The first supply/drain port 67*a* is connected with (is open to) a downstream portion of the second supply/drain passage 6. The second supply/drain port 67*b* is connected with (is open to) the third control oil chamber 33 through a supply/drain passage portion 6*b*. This supply/drain passage portion 6*b* is formed between the pilot valve 60 and the third communication hole 25*c* of the pump body 11. The drain port 67*c* is located below the second supply/drain port 67*b* (i.e. located between the second supply/drain port 67*b* and the plug 68) and extends parallel to the second supply/drain port 67*b*. The drain port 67 is connected with (is open to) a drain passage 53. Moreover, the peripheral wall of the valve body 61 is formed with a back-pressure relief port 67*d* which passes through the peripheral wall of the valve body 61 in the radial direction of the valve body 61. The back-pressure relief port 67*d* is located below the drain port 67*c* (i.e. located between the drain port 67*c* and the plug 68), and ensures a smooth sliding movement of the spool valve 63.

The spool valve 63 includes a first land portion 63*a*, a small-diameter shaft portion 63*b* and a second land portion 63*c*. The first land portion 63*a* constitutes one end portion of the spool valve 63 at an uppermost location among the first land portion 63*a*, the small-diameter shaft portion 63*b* and the second land portion 63*c* as viewed in FIGS. 5A and 5B, i.e. is closest to the pilot-pressure introduction port 65. The second land portion 63*c* is located below the small-diameter shaft portion 63*b* located below the first land portion 63*a* as viewed in FIGS. 5A and 5B. That is, the small-diameter shaft portion 63*b* is located between the first land portion 63*a* and the second land portion 63*c*.

A diameter of the first land portion 63*a* is equal to a diameter of the second land portion 63*c*. Each of the first land portion 63*a* and the second land portion 63*c* slides in the sliding hole 62 to have a minute clearance between the inner circumferential surface of the sliding hole 62 and an outer circumferential surface of the corresponding land portion 63*a*, 63*c*.

The first land portion 63*a* is formed in a substantially cylindrical-column shape. As shown in FIGS. 5A and 5B, an upper surface of the first land portion 63*a* functions as a pressure-receiving surface which receives the discharge pressure introduced into the pilot-pressure introduction port 65. When the spool valve 63 moves upward or downward, the first land portion 63*a* opens or closes the first supply/drain port 67*a*. That is, when the spool valve 63 is in its uppermost position as shown in FIG. 5A, the first supply/drain port 67*a* is open to (i.e. communicates with) the second supply/drain port 67*b*. On the other hand, when the spool valve 63 is in its downward position, the first supply/drain port 67*a* is in a closed state.

The second land portion 63*c* opens or closes the drain port 67*c* when the spool valve 63 moves downward or upward. That is, when the spool valve 63 is in its uppermost position as shown in FIG. 5A, the drain port 67*c* is in a closed state. On the other hand, when the spool valve 63 is in its predetermined downward position as shown in FIG. 5B, the drain port 67*c* is open to (i.e. communicates with) the second supply/drain port 67*b*.

An annular groove 63*d* is kept in a radially outer region of the small-diameter shaft portion 63*b*, i.e. is given between the surface of the sliding hole 62 and an outer circumferential surface of the small-diameter shaft portion 63*b*. The annular groove 63*d* is in a tapered annular shape. The annular groove 63*d* appropriately communicates (i.e. connects) the first supply/drain port 67*a* with the second supply/drain port 67*b*, or communicates (i.e. connects) the second supply/drain port 67*b* with the drain port 67*c* in accordance with the upward/downward movement of the spool valve 63.

A spring force of the valve spring 64 is smaller than that of the spring 18 of the oil pump 10.

[Operations of Variable Displacement Pump]

Operations of the variable displacement pump in the first embodiment will now be explained referring to FIGS. 6 to 9.

In a range from an engine operating state produced at the time of engine start to an engine operating state having a low rotational speed, a low load and a low oil temperature, the oil pump 10 takes a first working mode as shown in FIG. 6. In this mode, hydraulic pressure is always supplied to the first control oil chamber 31. The control unit outputs the ON signal to the first electromagnetic changeover valve 40 and the second electromagnetic changeover valve 50 so that the first electromagnetic changeover valve 40 and the second electromagnetic changeover valve 50 are energized. Hence, as to each of the first electromagnetic changeover valve 40 and the second electromagnetic changeover valve 50, the communication port 45 communicates with the drain port 46 as shown in FIG. 4B.

As to the pilot valve 60, a slight hydraulic pressure is applied to the upper surface of the spool valve 63 because the low engine speed causes a low oil pressure. However, by the biasing force of the spring 64, the first land portion 63*a* of the spool valve 63 is seated on the seating surface (tapered surface) 61*a* as shown in FIG. 5A. Hence, the first supply/drain port 67*a* is open to the second supply/drain port 67*b*, and the second supply/drain port 67*b* communicates through the communication port 45 of the second electromagnetic changeover valve 50 with the drain port 46.

Therefore, hydraulic pressures in the second control oil chamber 32 and the third control oil chamber 33 are drained so that each of the second control oil chamber 32 and the third control oil chamber 33 is in a low-pressure state.

Figure 10:
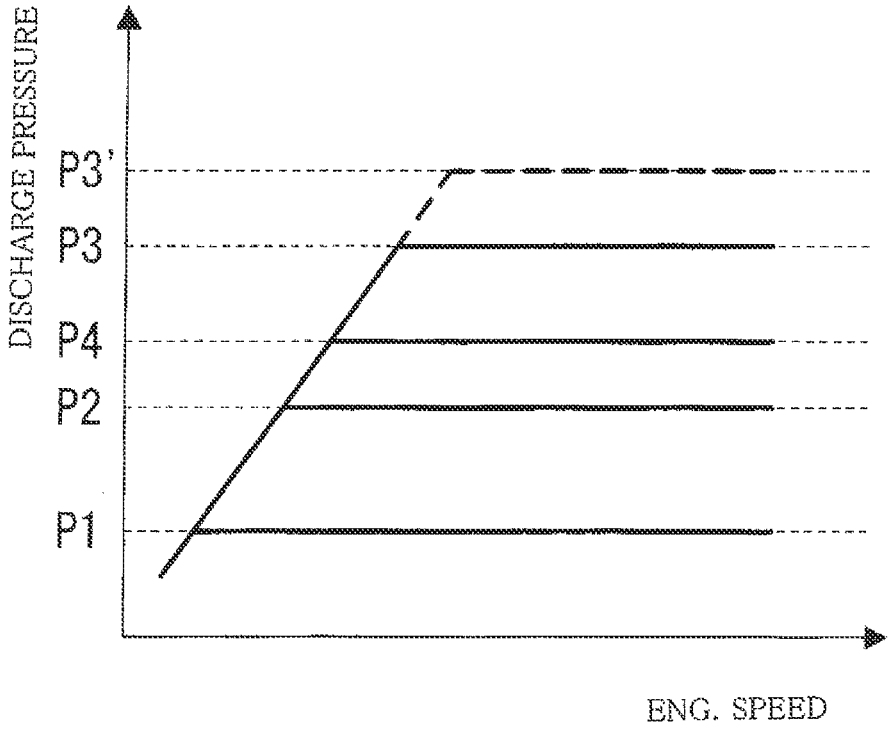
FIG. 10 is a graph showing a relation between an engine speed and a discharge pressure of the variable displacement pump in the first embodiment.

Accordingly, with a rise of the engine speed, the oil-pressure characteristic of the oil pump 10 is controlled to the low level as shown by P1 of FIG. 10.

Next, in the case that an engine operating state in which the oil jet for spraying oil to the piston is necessary comes because the engine load and the engine oil temperature rise, the oil pump 10 takes a second working mode as shown in FIG. 7. In this mode, the control unit outputs the ON signal (energization signal) to the second electromagnetic changeover valve 50, and outputs the OFF signal (non-energization signal) only to the first electromagnetic changeover valve 40. Hence, as to the first electromagnetic changeover valve 40, the ball valving element 43 opens the solenoid opening port 42*a* such that the solenoid opening port 42*a* communicates with the communication port 45 by the backward movement of the pushrod 47 as shown in FIG. 4A.

Therefore, although the third control oil chamber 33 remains in the low-pressure state, the discharge pressure is supplied to the second control oil chamber 32 as shown in FIG. 7. Thereby, the discharge pressure supplied to the second control oil chamber 32 cooperates with the spring force of the spring 18 to swing the cam ring 17 in the clockwise direction and then to be balanced with a reaction force of the cam ring 17. Accordingly, the oil-pressure characteristic of the oil pump 10 is controlled to a level P2 shown in FIG. 10 which is greater than the level P1.

Next, in the case that an engine operating state in which a higher level of oil pressure is necessary comes because the engine speed and the engine oil temperature (or the like) further rise, the oil pump 10 takes a third working mode as shown in FIG. 8. In this mode, the control unit outputs the OFF signal (non-energization signal) to both of the first electromagnetic changeover valve 40 and the second electromagnetic changeover valve 50. Hence, in each of the first electromagnetic changeover valve 40 and the second electromagnetic changeover valve 50, the ball valving element 43 opens the solenoid opening port 42*a* such that the solenoid opening port 42*a* communicates with the communication port 45 by the backward movement of the pushrod 47 as shown in FIG. 4A.

Therefore, the discharge pressure is supplied to both of the second control oil chamber 32 and the third control oil chamber 33 to further assist the spring force of the spring 18. The discharge pressure supplied to both of the second control oil chamber 32 and the third control oil chamber 33 cooperates with the spring 18 to further swing the cam ring 17 in the clockwise direction and then to be balanced with a reaction force of the cam ring 17 when the discharge pressure becomes equal to a level P3' greater than the level P2. Accordingly, the oil-pressure characteristic of the oil pump 10 would be controlled to the maximum level P3' shown in FIG. 10 if it were not for the pilot valve 60.

At this time, high oil pressure of the control passage 3 (the second supply/drain passage 6) is applied through the pilot-pressure supply passage portion 6*a* to the upper surface of the spool valve 63 of the pilot valve 60. Thereby, the spool valve 63 moves backwardly (i.e. toward the plug 68) against the biasing force of the spring 64, so that the first land portion 63*a* closes the first supply/drain port 67*a*, and the second supply/drain port 67*b* communicates through the annular groove 63*d* with the drain port 67*c* under a condition that the discharge pressure is equal to a level P3, as shown in FIG. 5B.

That is, at this time, hydraulic pressure of the third control oil chamber 33 is slightly reduced so as to slightly swing the cam ring 17 in the counterclockwise direction. As a result, the oil-pressure characteristic of the oil pump 10 is controlled to the level P3 shown in FIG. 10, i.e. is controlled to be reduced from the level P3' to the level P3.

In the third working mode, the discharge pressure of the oil pump 10 can be brought to its highest value in the first embodiment. Therefore, the third working mode is normally used when the engine speed is in a high-speed region. In this mode, the cam ring 17 can be inhibited from being swung to fluctuate the discharge pressure due to hydraulic-pressure imbalance (i.e., due to an erroneous hydraulic-pressure level) radially inside the cam ring 17 which is caused due to a cavitation or an air mixing into oil of the oil pan 01.

Next, FIG. 9 shows a fourth working mode of the oil pump 10. That is, when the engine speed rises from a low-speed region to a predetermined speed, the control unit outputs the ON signal (energization signal) to the first electromagnetic changeover valve 40 and outputs the OFF signal (non-energization signal) to the second electromagnetic changeover valve 50. Hence, oil of the second control oil chamber 32 is drained so that hydraulic pressure of the second control oil chamber 32 is low. On the other hand, the pump discharge pressure is supplied through the pilot valve 60 to the third control oil chamber 33 so that hydraulic pressure of the third control oil chamber 33 is increased to assist the biasing force of the spring 18. Thereby, the cam ring 17 is swung in the clockwise direction (that increases the eccentricity amount) so as to adjust the pump discharge pressure to a level P4. Accordingly, the oil-pressure characteristic of the oil pump 10 is controlled to the level P4 shown in FIG. 10 which is greater than the level P1.

The level P4 is lower than the level P3. Moreover, a magnitude relation between the level P4 and the level P2 depends on locations and sizes of the second control oil chamber 32 and the third control oil chamber 33, i.e. depends on the radii R2 and R3 and sizes of the second pressure-receiving surface 34*b* and the third pressure-receiving surface 34*c*.

The following table 1 shows a relation among the supply/drain to each of the first control oil chamber 31, the second control oil chamber 32 and the third control oil chamber 33, the ON/OFF status of each of the first electromagnetic changeover valve 40 and the second electromagnetic changeover valve 50, and the discharge pressure (i.e. controlled oil pressure) in the above-mentioned first to fourth working modes of the oil pump 10.

TABLE 1

| | | First control oil chamber | Second control oil chamber (First electromagnetic changeover valve) | Third control oil chamber (Second electromagnetic changeover valve) | Discharge pressure |
|---|---|---|---|---|---|
| One-chamber introduction | First working mode (FIG. 6) | SUPPLY | DRAIN (ON) | DRAIN (ON) | P1 |
| Two-chamber introduction | Second working mode (FIG. 7) | SUPPLY | SUPPLY (OFF) | DRAIN (ON) | P2 |
| | Fourth working mode (FIG. 9) | SUPPLY | DRAIN (ON) | SUPPLY (OFF) | P4 |
| Three-chamber introduction | Third working mode (FIG. 8) | SUPPLY | SUPPLY (OFF) | SUPPLY (OFF) | P3 (P3') |

As is clear from the table 1, the discharge pressure of the oil pump 10 can be adjusted to more than three levels (three stages) by switching between the ON state (energization) and the OFF state (non-energization) in each of the first electromagnetic changeover valve 40 and the second electromagnetic changeover valve 50, as needed basis in accordance with the engine speed, the engine load, the engine oil temperature, the water temperature or the like.

That is, a minimum oil pressure necessary to actuate a variable valve system such as the valve-timing control device (VTC) is achieved in a region over which the level P1 is selected as the pump discharge pressure. In a region over which the level P2 is selected as the pump discharge pressure, an oil pressure necessary for the oil jet to spray cooling oil to the piston is achieved. In a region over which the level P3 is selected as the pump discharge pressure, an oil pressure necessary for the bearing of the crankshaft at the time of high engine speed is achieved. A region over which the level P4 is selected as the pump discharge pressure may be set in the case that the discharge pressure needs to be controlled to four levels (four stages) or more, for example in the case that an spray quantity of the oil jet needs to be adjusted to two levels. Moreover, because a feedback control is unnecessary in the first embodiment, a control mechanism can be simplified.

Furthermore, in the first embodiment, the maximum level P3 is obtained as the discharge pressure when the first electromagnetic changeover valve 40 and the second electromagnetic changeover valve 50 are not in the energized state, in consideration of a failure such as a coil breaking (disconnection) of the first electromagnetic changeover valve 40 or the second electromagnetic changeover valve 50. However, an opposite ON/OFF structure for the first electromagnetic changeover valve 40 and the second electromagnetic changeover valve 50 may be employed in consideration of power saving.

[Second Embodiment]

Figure 11:
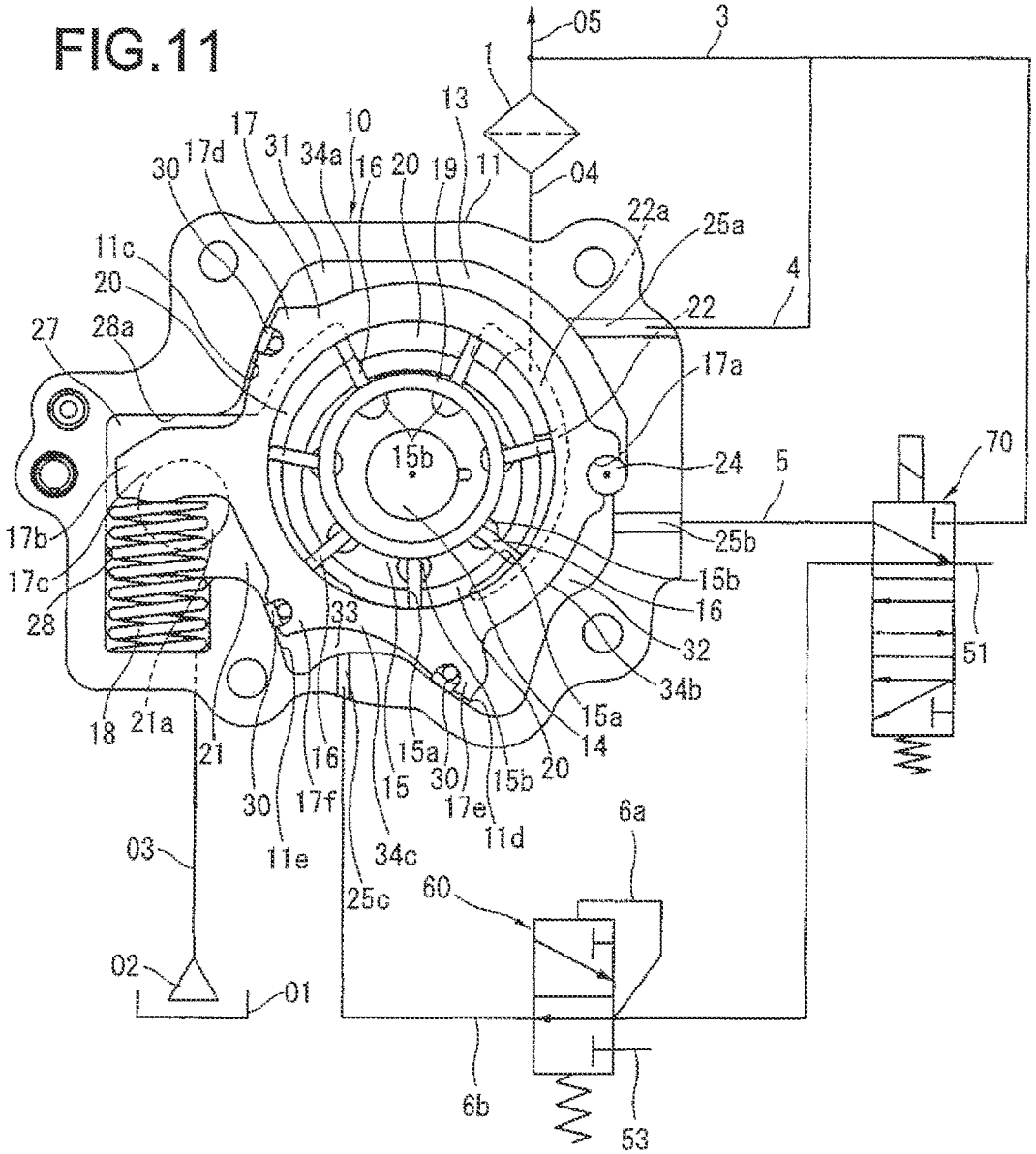
FIG. 11 is a schematic view showing an oil pump and a hydraulic circuit in a variable displacement pump of a second embodiment according to the present invention.

FIG. 11 shows a second embodiment according to the present invention. A configuration of the second embodiment is the same as the above-mentioned configuration of the first embodiment, except that the first electromagnetic changeover valve 40 and the second electromagnetic changeover valve 50 (of the first embodiment) are collected as a single electromagnetic changeover valve 70.

Figure 12A:
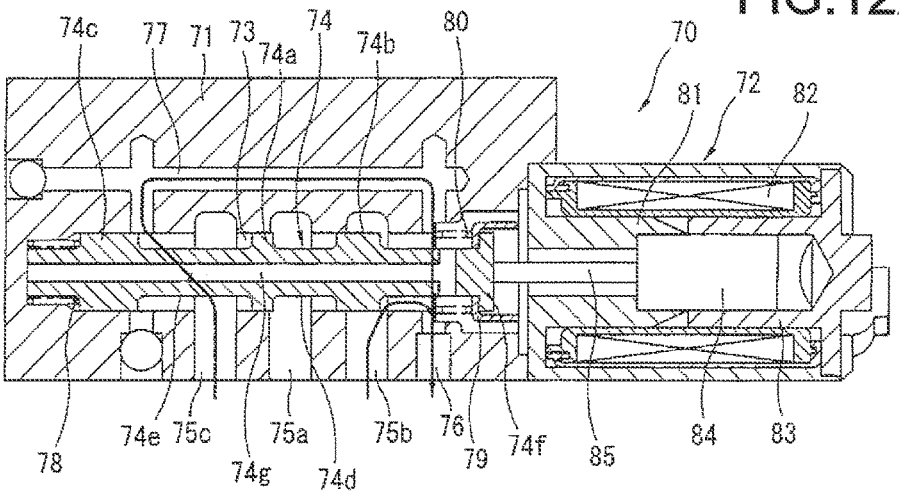
FIG. 12A is a vertical sectional view of an electromagnetic changeover valve in the second embodiment, and shows a state where a spool valve closes a supply port and communicates the first and second communication ports with a drain port.
Figure 12B:
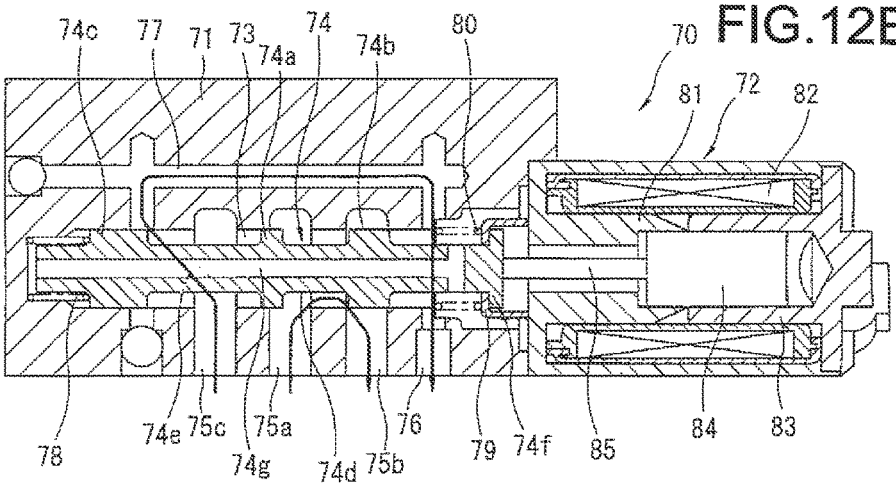
FIG. 12B is a vertical sectional view of the electromagnetic changeover valve in the second embodiment, and shows a state where the spool valve communicates the supply port with the first communication port and communicates the second communication port with the drain port.
Figure 12C:
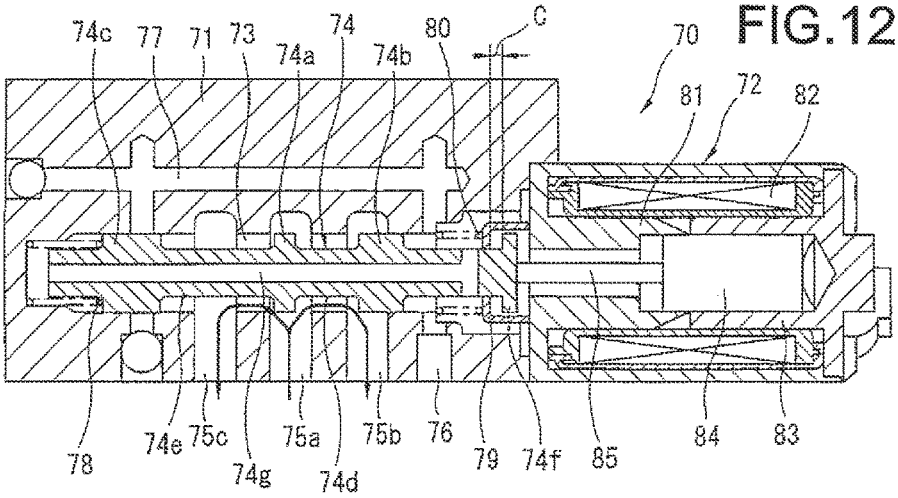
FIG. 12C is a vertical sectional view of the electromagnetic changeover valve in the second embodiment, and shows a state where the spool valve communicates the supply port with the first and second communication ports.

The electromagnetic changeover valve 70 has five ports and three stages. As shown in FIGS. 12A to 12C, the electromagnetic changeover valve 70 includes a valve body 71 and a solenoid unit 72. The valve body 71 is inserted into and fixed to the cylinder block. The solenoid unit 72 is provided at a rear end portion of the valve body 71.

The valve body 71 is formed with a valve hole 73 which extends in an axial direction of the valve body 71 inside the valve body 71. A spool valve 74 is provided to be able to slide in the valve hole 73 in the axial direction of the valve body 71. A peripheral wall of the valve body 71 is formed with a supply port 75*a* which passes through the peripheral wall in a radial direction of the valve body 71. The supply port 75*a* communicates (connects) the valve hole 73 with the control passage 3. Moreover, the peripheral wall of the valve body 71 is formed with a first communication port 75*b* and a second communication port 75*c* which pass through the peripheral wall in the radial direction of the valve body 71. The first communication port 75*b* communicates (connects) the second control oil chamber 32 with the valve hole 73. The second communication port 75*c* communicates (connects) the third control oil chamber 33 with the valve hole 73. The supply port 75*a* is located between the first communication port 75*b* and the second communication port 75*c* with respect to the axial direction of the valve body 71.

Moreover, the peripheral wall of the valve body 71 is formed with a drain port 76 which passes through the peripheral wall in the radial direction of the valve body 71. The drain port 76 is appropriately communicated with (is opened to) the first communication port 75*b* through the valve hole 73, and also is appropriately communicated with (is opened to) the second communication port 75*c* through a drain passage 77, in accordance with a sliding position of the spool valve 74. The drain passage 77 is formed in the peripheral wall of the valve body 71 to extend in the axial direction and also the radial direction of the valve body 71 as shown in FIGS. 12A to 12C. The drain port 76 is located axially adjacent to the first communication port 75*b*. That is, the drain port 76, the first communication port 75*b*, the supply port 75*a* and the second communication port 75*c* are arranged in this order from a location of the solenoid unit 72, with respect to the axial direction of the valve body 71.

The spool valve 74 is formed with a pressure hole 74*g* which extends in the axial direction inside the spool valve 74. The spool valve 74 includes a first land portion 74*a*, a second land portion 74*b* and a third land portion 74*c*. The first land portion 74*a* has a narrow width and is located at a substantially center of an outer circumferential surface of the spool valve 74 with respect to the axial direction of the spool valve 74. The second land portion 74*b* is located in one end portion of the outer circumferential surface of the spool valve 74, and selectively communicates the first communication port 75*b* with one of the supply port 75*a* and the drain port 76 such that another of the supply port 75*a* and the drain port 76 is blocked from the first communication port 75*b*. The third land portion 74*c* is located in another end portion of the outer circumferential surface of the spool valve 74, and appropriately communicates/blocks the drain passage 77 with/from the second communication port 75*c*. Axially one end portion of the pressure hole 74*g* passes through the spool valve 74 whereas axially another end portion of the pressure hole 74*g* is open to the drain port 76 through a radial hole 74*h* as shown in FIGS. 12A to 12C. Hence, a hydraulic-pressure difference between axially both end portions of the spool valve 74 is suppressed, so that the spool valve 74 is inhibited from unnecessarily moving in the axial direction.

The spool valve 74 is formed with two annular passage grooves 74*d* and 74*e*. The annular passage groove 74*d* is formed between the first land portion 74*a* and the second land portion 74*b*, and the annular passage groove 74*e* is formed between the first land portion 74*a* and the third land portion 74*c*. The spool valve 74 further includes a flange portion 74*f* at a tip portion of the spool valve 74 which is near the solenoid unit 72. The flange portion 74*f* is formed integrally with the spool valve 74. The spool valve 74 is biased in the axial direction (toward the solenoid unit 72) by a first valve spring 78 such that the flange portion 74*f* is elastically in contact with a tip of an after-mentioned pushrod 85 of the solenoid unit 72. This valve spring 78 is elastically attached to a rear end portion of the spool valve 74 (which is located opposite to the solenoid unit 72).

A retainer 79 is provided at the tip portion of the spool valve 74. As shown in FIGS. 12A to 12C, an outer circumferential surface of the flange portion 74*f* of the spool valve 74 is fitted into the retainer 79 such that the retainer 79 is slidable in the axial direction. The retainer 79 is formed in a U-shape in cross section, and is biased toward the solenoid unit 72 by a second valve spring 80 whose one end is elastically attached to a step portion (recess portion) of the valve hole 73 near the drain port 76, as shown in FIGS. 12A to 12C.

The solenoid unit 72 mainly includes a cylindrical body 81, a tubular coil 82, a fixing yoke 83, a movable plunger 84 and the pushrod 85. The tubular coil 82 is accommodated inside the cylindrical body 81. The fixing yoke 83 is in a tubular shape having its lid, and is fixed to an inner circumferential surface of the coil 82. The movable plunger 84 is provided inside the fixing yoke 83 and is able to slide on an inner circumferential surface of the fixing yoke 83. (A base end of) The pushrod 85 is integrally fixed to a tip portion of the movable plunger 84. The tip (i.e. another end) of the pushrod 85 is in contact with a front end surface of the flange portion 74*f* of the spool valve 74 as mentioned above.

A pulse electric-current having a duty ratio equal to 50 or 100%(percent) is outputted to the coil 82 by the control unit. Otherwise, the coil 82 is in a not-energized state.

[Operations of Variable Displacement Pump]

Operations of the variable displacement pump in the second embodiment will now be explained. In an operating region of the level P1 in which the required hydraulic pressure is at the minimum level when the engine speed is in the low-speed region, the control unit outputs electric-current having the duty ratio equal to 100%, to the coil 82 of the electromagnetic changeover valve 70. Thereby, the coil 82 is excited. Hence, as shown in FIG. 12A, the movable plunger 84 moves forwardly in a left direction (of FIG. 12A) to a maximum degree, and thereby pushes the spool valve 74 through the pushrod 85 in the left direction to its maximum degree against the biasing forces of the first valve spring 78 and the second valve spring 80.

At this time, the supply port 75*a* is closed by the first land portion 74*a* and the second land portion 74*b*, and each of the first communication port 75*b* and the second communication port 75*c* is communicated with (is opened to) the drain port 76.

Figure 15:
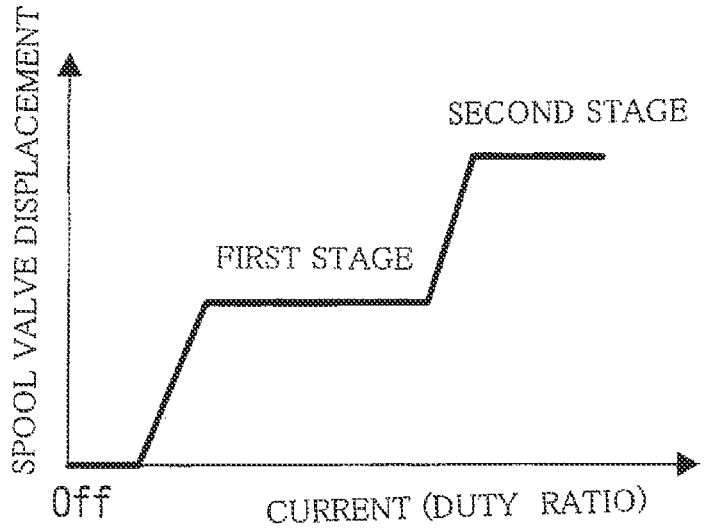
FIG. 15 is a characteristic view showing a relation between a displacement of the spool valve and an electric-current (duty ratio) to the electromagnetic changeover valve in the second embodiment.

At this time, a relation between electric current and a displacement (movement amount) of the spool valve 74 is shown by a "second stage" of FIG. 15.

Figure 17:
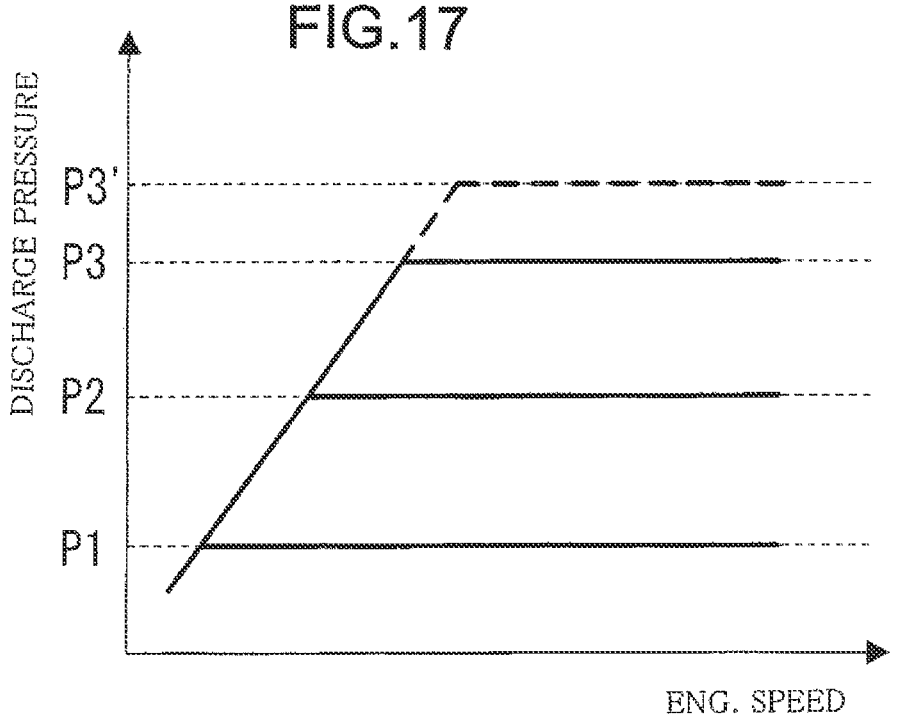
FIG. 17 is a graph showing a relation between the engine speed and a discharge pressure of the variable displacement pump in the second embodiment.

Accordingly, as shown in FIG. 11, oil retained in the second control oil chamber 32 and the third control oil chamber 33 is drained so that the second control oil chamber 32 and the third control oil chamber 33 are in the low-pressure state. That is, the pump discharge pressure is applied only to the first control oil chamber 31. Therefore, at this time, the discharge pressure of the oil pump 10 attains an oil-pressure characteristic shown by the level P1 of FIG. 17, in the same manner as the first working mode of the first embodiment.

Next, when an engine operating state in which the oil jet needs to spray oil to the piston comes, the control unit outputs electric-current having the duty ratio equal to 50%, to the coil 82 of the electromagnetic changeover valve 70. Thereby, the coil 82 is excited. Hence, as shown in FIG. 12B, the movable plunger 84 moves backwardly in a right direction (of FIG. 12B), and thereby moves the spool valve 74 substantially to an axially center position of the spool valve 74 through the pushrod 85 by use of biasing forces of the first valve spring 78 and the second valve spring 80.

At this time, the supply port 75*a* is communicated with the first communication port 75*b* by the first land portion 74*a* and the second land portion 74*b*, and the second communication port 75*c* is open to the drain port 76.

At this time, a relation between electric current and the displacement (movement amount) of the spool valve 74 is shown by a "first stage" of FIG. 15.

Figure 13:
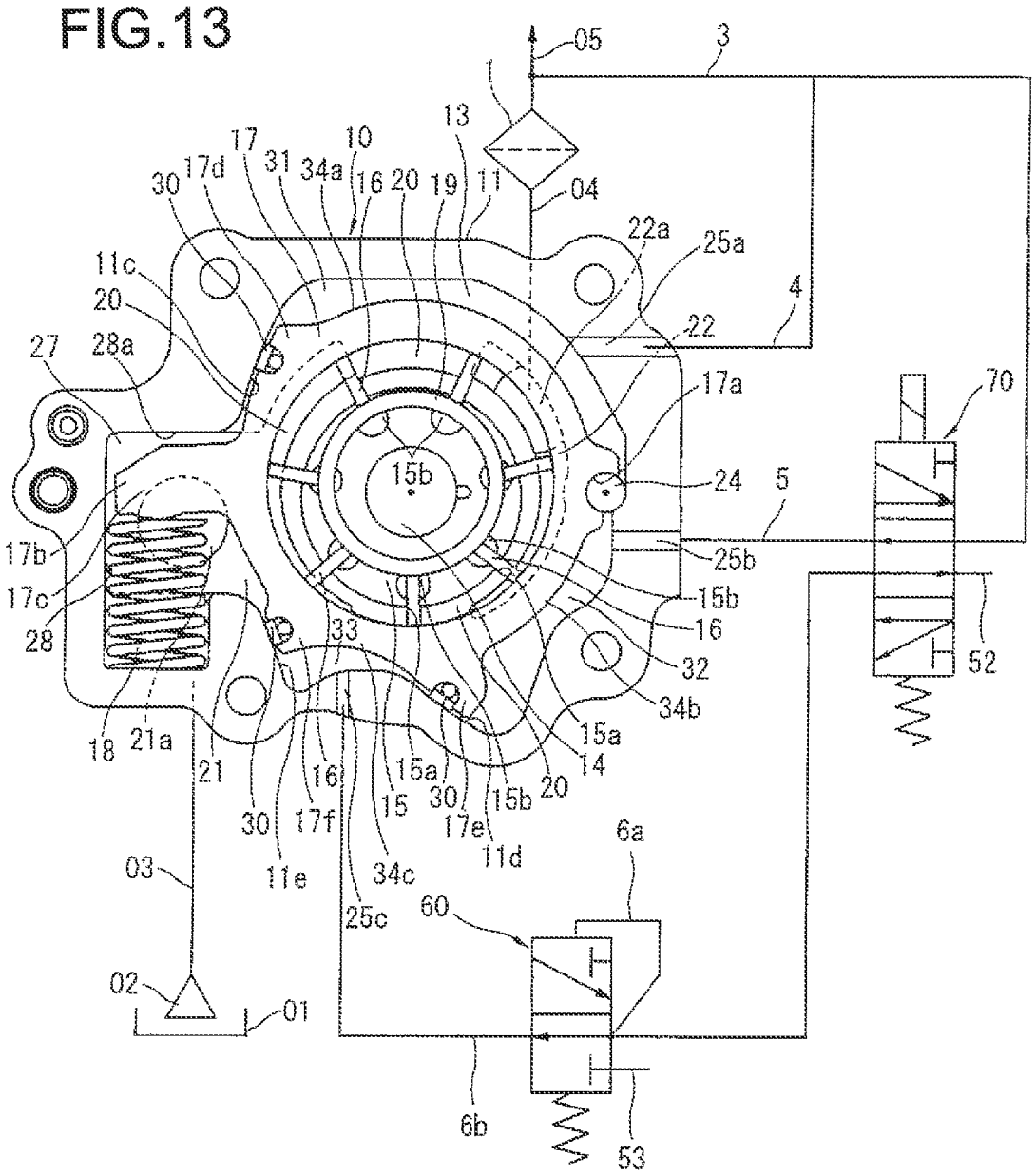
FIG. 13 is an explanatory view for operations of the variable displacement pump in the second embodiment.

Accordingly, as shown in FIG. 13, oil retained in the third control oil chamber 33 is drained so that the third control oil chamber 33 is in the low-pressure state whereas the pump discharge pressure is applied to the second control oil chamber 32 to increase internal pressure of the second control oil chamber 32. Therefore, at this time, the discharge pressure of the oil pump 10 attains an oil-pressure characteristic shown by the level P2 of FIG. 17, in the same manner as the second working mode of the first embodiment.

Next, when the engine speed further rises, the control unit outputs electric-current having a duty ratio equal to 0%, to the coil 82 of the electromagnetic changeover valve 70. That is, the coil 82 receives no electric-current, and thereby is demagnetized. Hence, as shown in FIG. 12C, the movable plunger 84 moves backwardly in a right direction (of FIG. 12B) to a maximum degree, and thereby moves the spool valve 74 to an axially rightmost position of the spool valve 74 (i.e. toward the solenoid unit 72 to a maximum degree) through the pushrod 85 by use of biasing force of the first valve spring 78.

At this time, the supply port 75*a* is communicated with the first communication port 75*b* and the second communication port 75*c* by the first land portion 74*a*, the second land portion 74*b* and the third land portion 74*c*. Moreover, the drain port 76 is blocked from communicating with the first communication port 75*b* and the second communication port 75*c* by the second land portion 74*b* and the third land portion 74*c*.

At this time, a relation between electric current and the displacement (movement amount) of the spool valve 74 is shown by a lowest stage of FIG. 15.

Figure 14:
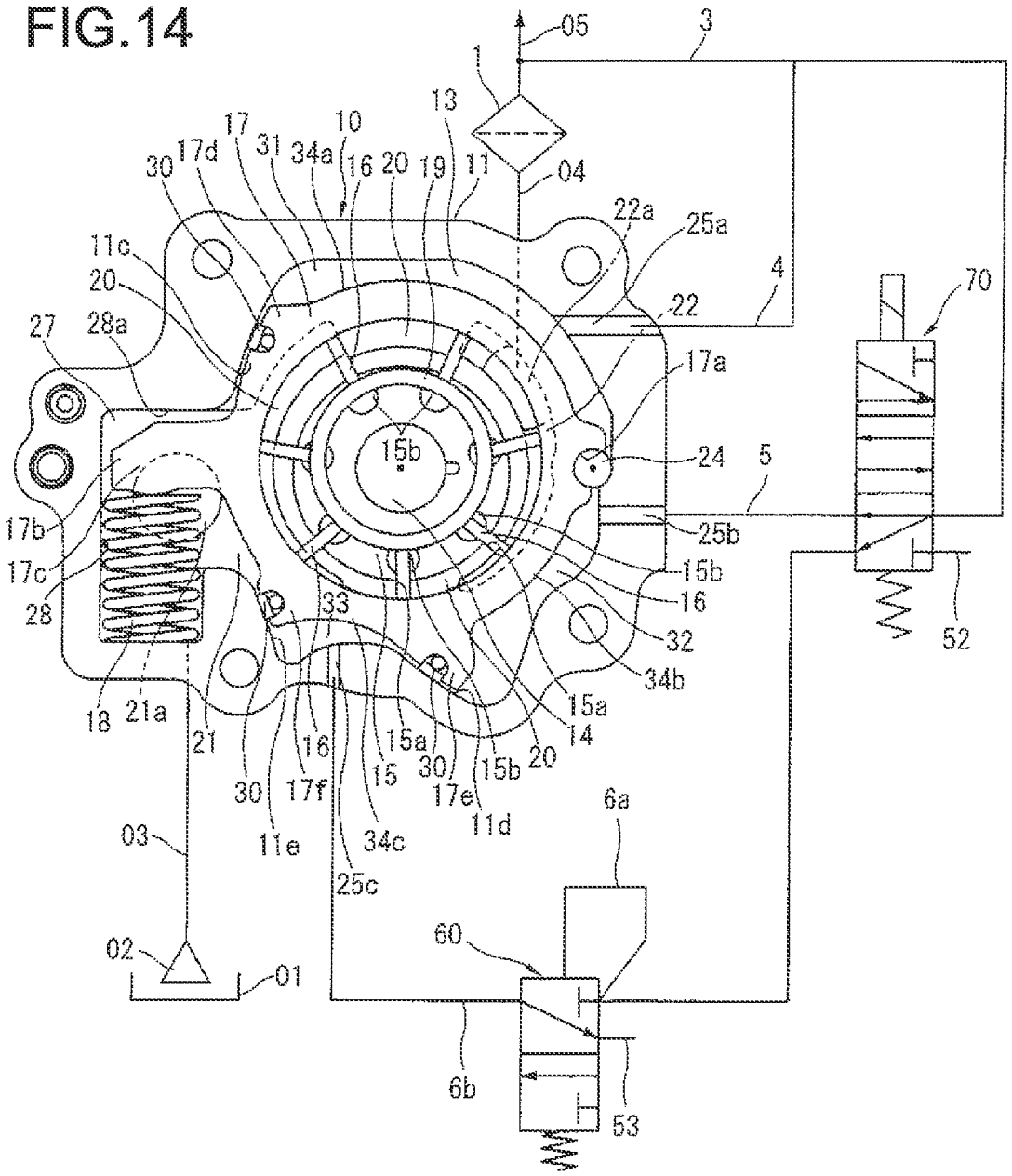
FIG. 14 is an explanatory view for operations of the variable displacement pump in the second embodiment.

Accordingly, as shown in FIG. 14, the pump discharge pressure is applied to both of the second control oil chamber 32 and the third control oil chamber 33 so that internal pressures of the second control oil chamber 32 and the third control oil chamber 33 are increased. Therefore, if it were not for the pilot valve 60, the discharge pressure of the oil pump 10 would attain a high-oil-pressure characteristic shown by the level P3' of FIG. 17, in the same manner as the third working mode of the first embodiment. However, as explained in the first embodiment, the discharge pressure of the oil pump 10 actually attains an oil-pressure characteristic shown by the level P3 of FIG. 17 because of actions of the pilot valve 60.

At this time, the spool valve 74 is in the axially rightmost position such that a predetermined clearance C is formed between the flange portion 74*f* and a bottom wall of the retainer 79 as shown in FIG. 12C.

Figure 16:
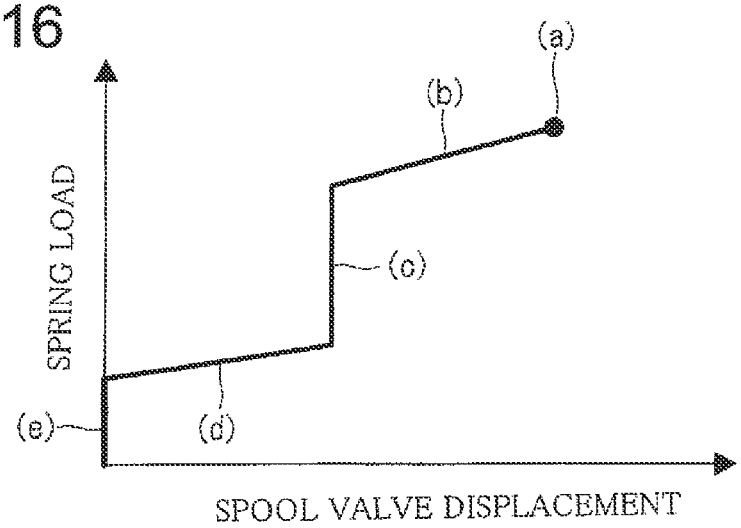
FIG. 16 is a characteristic view showing a relation between the displacement of the spool valve and a spring load in the second embodiment.

As shown in FIG. 16, a relation between the displacement of the spool valve 74 and a spring load given to the first valve spring 78 and the second valve spring 80 exhibits a stepwise characteristic. Explanations about FIGS. 12 and 16 are as follows.

Under the condition of FIG. 12C, a tip (i.e. solenoid-unit-side end) of the retainer 79 is in contact with a front end wall (i.e. spool-valve-side end wall) of the body 81 of the solenoid unit 72 by spring force of the second valve spring 80. Moreover, because the flange portion 74*f* is not in contact with the retainer 79, spring force of the second valve spring 80 does not act on the spool valve 74, so that only the spring force of the first valve spring 78 acts on the spool valve 74.

Because the first valve spring 78 has a set load, the spool valve 74 does not move as shown by "(e)" of FIG. 16 when the spool valve 74 receives a force (load) smaller than or equal to the set load of the first valve spring 78. On the other hand, when the spool valve 74 receives a force larger than or equal to the set load of the first valve spring 78, the spool valve 74 moves (is displaced) in proportion to a total load of the spool valve 74 (i.e. spring total load) as shown by "(d)" of FIG. 16. A gradient of a line shown by "(d)" of FIG. 16 is equal to a spring constant of the first valve spring 78.

Under the condition of FIG. 12B, the spring force of the second valve spring 80 is also applied to the spool valve 74 because (the bottom wall of) the retainer 79 is in contact with the flange portion 74*f*. Because a set load is already given also to the second valve spring 80, the spool valve 74 does not move as shown by "(c)" of FIG. 16 when the spool valve 74 receives a force smaller than or equal to the sum in load of the first valve spring 78 and the second valve spring 80. On the other hand, when the spool valve 74 receives a force larger than or equal to the sum, the spool valve 74 moves (is displaced) in proportion to the total load of the spool valve 74 (i.e. spring total load) as shown by "(b)" of FIG. 16. A gradient of a line shown by "(b)" of FIG. 16 is equal to the sum of the spring constant of the first valve spring 78 and a spring constant of the second valve spring 80.

Under the condition of FIG. 12A, the spool valve 74 has moved in the left direction (of FIG. 12A) to a maximum degree against the spring forces of the first valve spring 78 and the second valve spring 80 such that the spool valve 74 is in contact with a remotest portion of the valve body 71 (i.e. in contact with a bottom of the valve hole 73). The condition of FIG. 12A corresponds to "(a)" of FIG. 16.

As shown in FIG. 16, the relation between the displacement of the spool valve 74 and the spring load given to the first valve spring 78 and the second valve spring 80 exhibits the stepwise characteristic. Hence, it is possible to displace the spool valve 74 in a stepwise manner even if a linear solenoid valve in which a thrust of the movable plunger 84 varies in proportion to the duty ratio or electric-current value is used. Therefore, three kinds of positions (three stages) as shown in FIG. 12 can be achieved in this embodiment.

[Third Embodiment]

Figure 18:
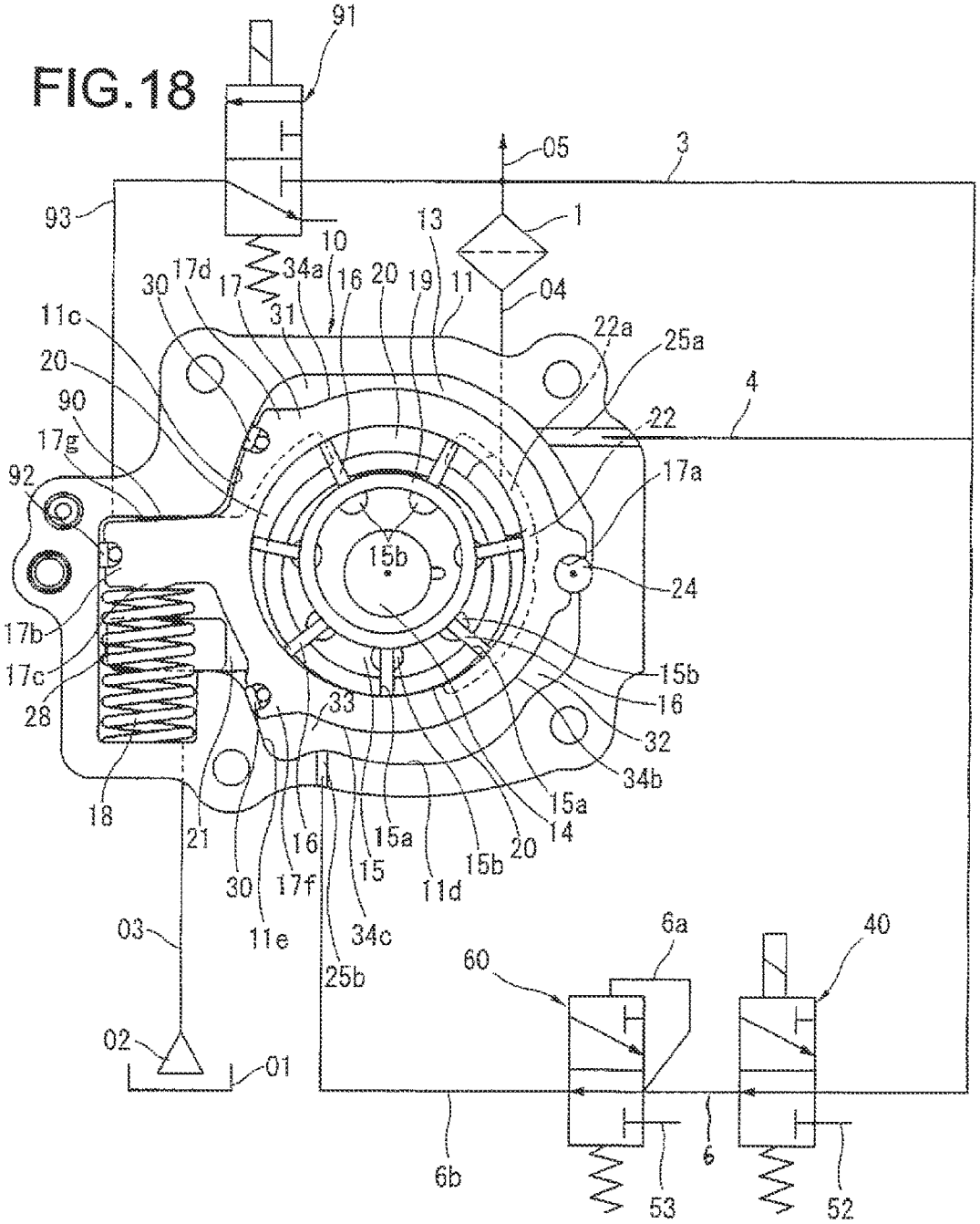
FIG. 18 is a schematic view showing an oil pump and a hydraulic circuit in a variable displacement pump of a third embodiment according to the present invention.

FIG. 18 shows a third embodiment according to the present invention. A configuration of the third embodiment is the same as the above embodiments, except the following. In the third embodiment, although the third control oil chamber is not provided, and a fourth control oil chamber 90 is provided between the stopper surface 28*a* of the spring receiving chamber 28 and the upper surface of the arm portion 17*b*. The fourth control oil chamber 90 cooperates with the first control oil chamber 31 to constitute the reduction-side oil chamber group.

The fourth control oil chamber 90 is able to communicate with the discharge passage 04 through a second control passage 93 which branches off from the discharge passage 04. A third electromagnetic changeover valve 91 is provided in the middle of the second control passage 93. Hydraulic pressure is supplied through the third electromagnetic changeover valve 91 to the fourth control oil chamber 90, and thereby an internal pressure of the fourth control oil chamber 90 acts on the cam ring 17 in the counterclockwise direction (in the direction that reduces the eccentricity amount) in cooperation with the first control oil chamber 31.

The second control oil chamber 32 has a large volume which is substantially equivalent to a sum of the second and third control oil chambers of the first embodiment. The pilot valve 60 is provided downstream of the first electromagnetic changeover valve 40.

Figure 19:
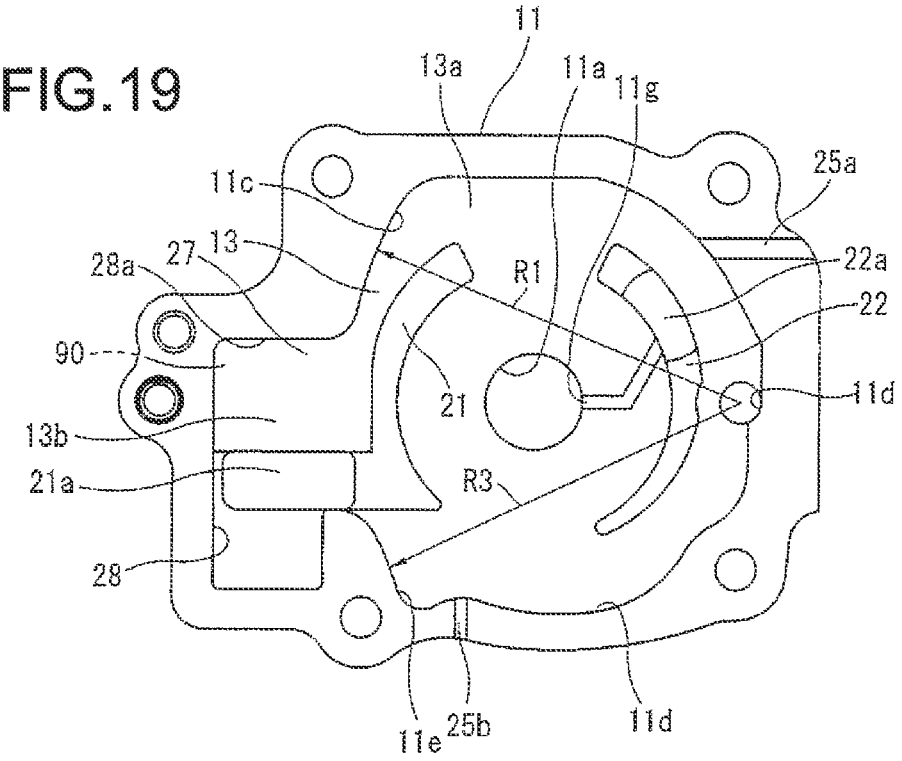
FIG. 19 is a front view of a pump body of the oil pump in the third embodiment.

As shown in FIG. 19, the bottom surface 13*a* of the pump body 11 is expanded (as compared with the first embodiment) to an upper end portion of the spring receiving chamber 28 such that an expanded portion 13*b* of the bottom surface 13*a* is formed. The fourth control oil chamber 90 is separately formed by, i.e. surrounded by the expanded portion 13*b*, the stopper surface 28*a* and the upper surface of the arm portion 17*b*.

Figure 20:
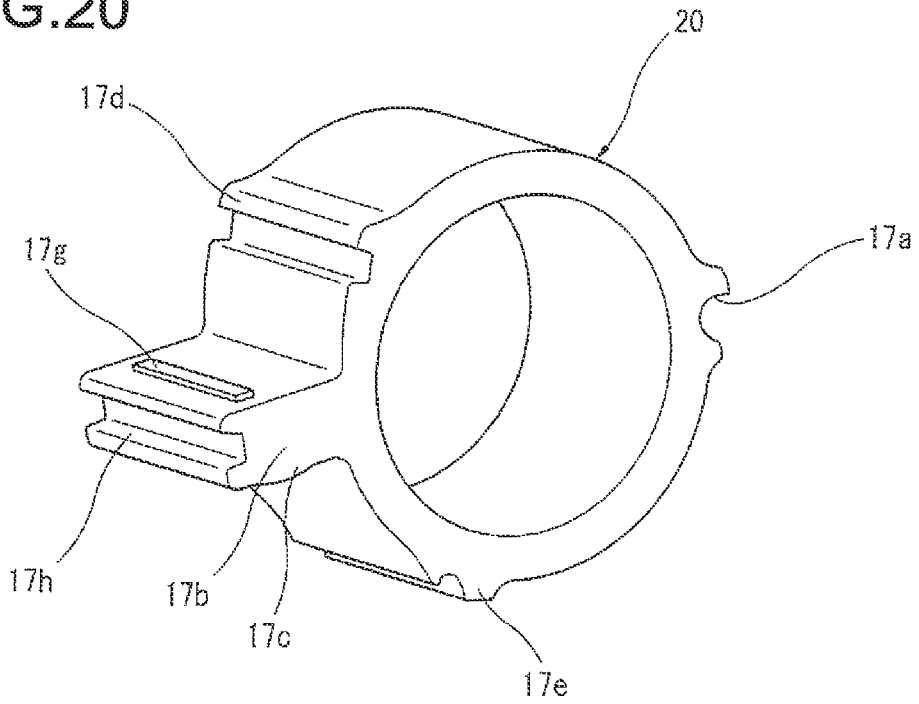
FIG. 20 is an oblique perspective view of a cam ring in the third embodiment.

As shown in FIG. 20, the arm portion 17*b* of the cam ring 17 is integrally formed with a thin and narrow protruding portion 17*g* which extends in the axial direction of the oil pump 10. The protruding portion 17*g* is in contact with the stopper surface 28*a* in order to utilize whole the upper surface of the arm portion 17*b* as an inner surface of the fourth control oil chamber 90. Moreover, the arm portion 17*b* is formed with a sealing groove 17*h* which is located at a tip portion of the arm portion 17*b* and which extends in the axial direction. A seal member 92 is fitted and held in the sealing groove 17*h*, and liquid-tightly seals the fourth control oil chamber 90. The first seal member 30 seals up between the fourth control oil chamber 90 and the first control oil chamber 31.

The third electromagnetic changeover valve 91 has the same structure as the first electromagnetic changeover valve 40 except the following, and therefore detailed explanations thereof will be omitted. As shown in the following table 2, the third electromagnetic changeover valve 91 is controlled by ON signal (energization) and OFF signal (non-energization) derived from the control unit, in an inverse manner as compared with the first electromagnetic changeover valve 40. That is, the first electromagnetic changeover valve 40 drains oil of the second control oil chamber 32 when receiving the ON signal. Contrary to this, when the third electromagnetic changeover valve 91 receives the ON signal, the pushrod 47 of the third electromagnetic changeover valve 91 moves backwardly (toward the solenoid unit 44) such that the ball valving element 43 communicates the solenoid opening port 42*a* with the communication port 45 so as to supply oil into the fourth control oil chamber 90. On the other hand, when the third electromagnetic changeover valve 91 receives the OFF signal, the pushrod 47 of the third electromagnetic changeover valve 91 moves forwardly (i.e. is pushed out) such that the ball valving element 43 closes the solenoid opening port 42*a* and communicates the communication port 45 with the drain port 46 so as to drain oil of the fourth control oil chamber 90.

TABLE 2

| | | First control oil chamber | Fourth control oil chamber (Third electromagnetic changeover valve) | Second control oil chamber (First electromagnetic changeover valve) | Discharge pressure |
|---|---|---|---|---|---|
| One-chamber introduction | First working mode (FIG. 22) | SUPPLY | DRAIN (OFF) | DRAIN (ON) | P2 |
| Two-chamber introduction | Second working mode (FIG. 21) | SUPPLY | SUPPLY (ON) | DRAIN (ON) | P1 |
| | Third working mode (FIGS. 18 and 23) | SUPPLY | DRAIN (OFF) | SUPPLY (OFF) | P3 (P3') |
| Three-chamber introduction | Fourth working mode | SUPPLY | SUPPLY (ON) | SUPPLY (OFF) | P4 |

Figure 21:
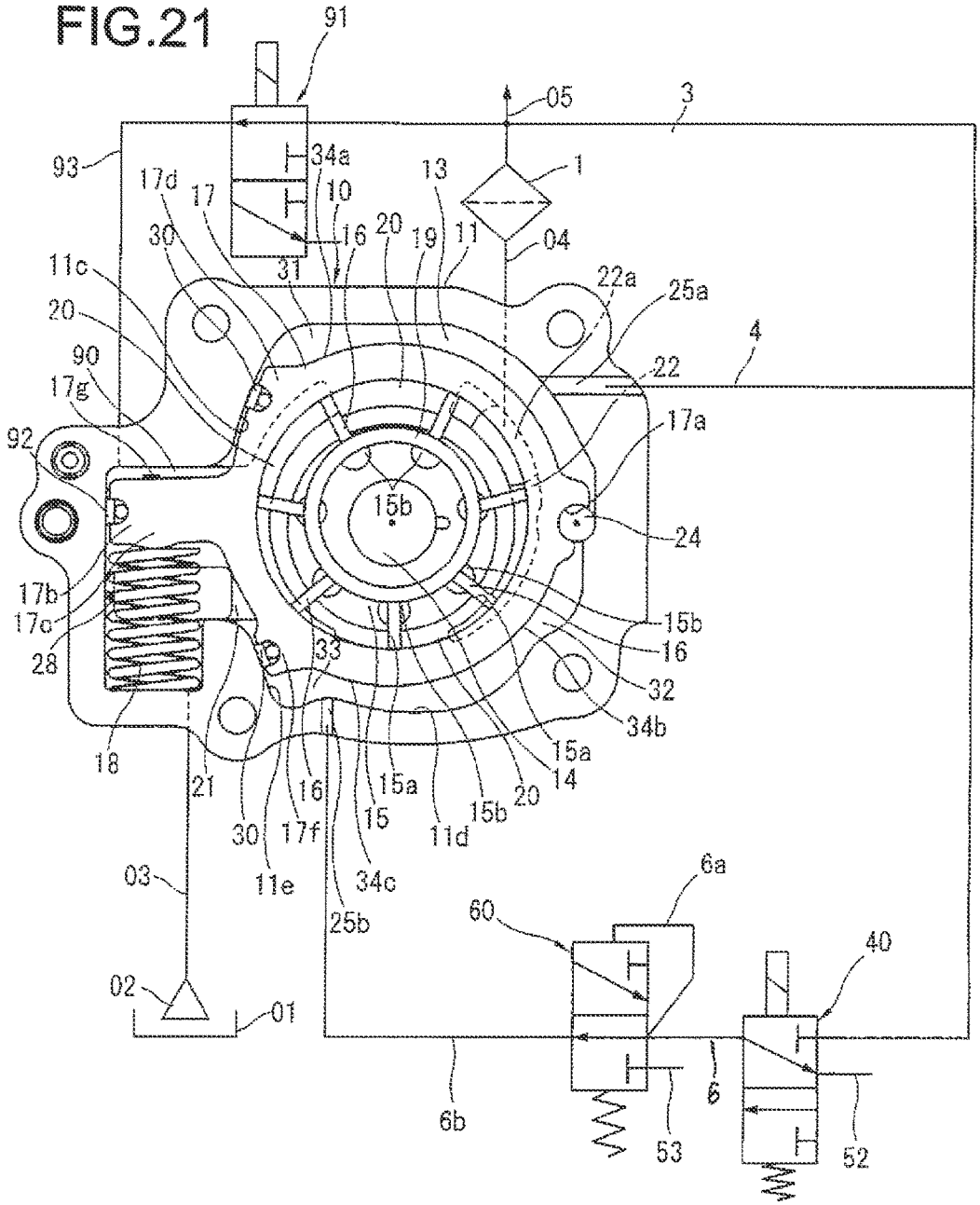
FIG. 21 is an explanatory view for operations of the variable displacement pump in the third embodiment.

Accordingly, when the engine speed is in the low-speed region, the ON signal is outputted to the third electromagnetic changeover valve 91 so that the discharge pressure is applied to the fourth control oil chamber 90 as shown in FIG. 21. At this time, the ON signal is also outputted to the first electromagnetic changeover valve 40 so that oil retained in the second control oil chamber 32 is drained. Therefore, the discharge pressure of the oil pump 10 is adjusted to the level shown by P1 in FIG. 10.

Figure 22:
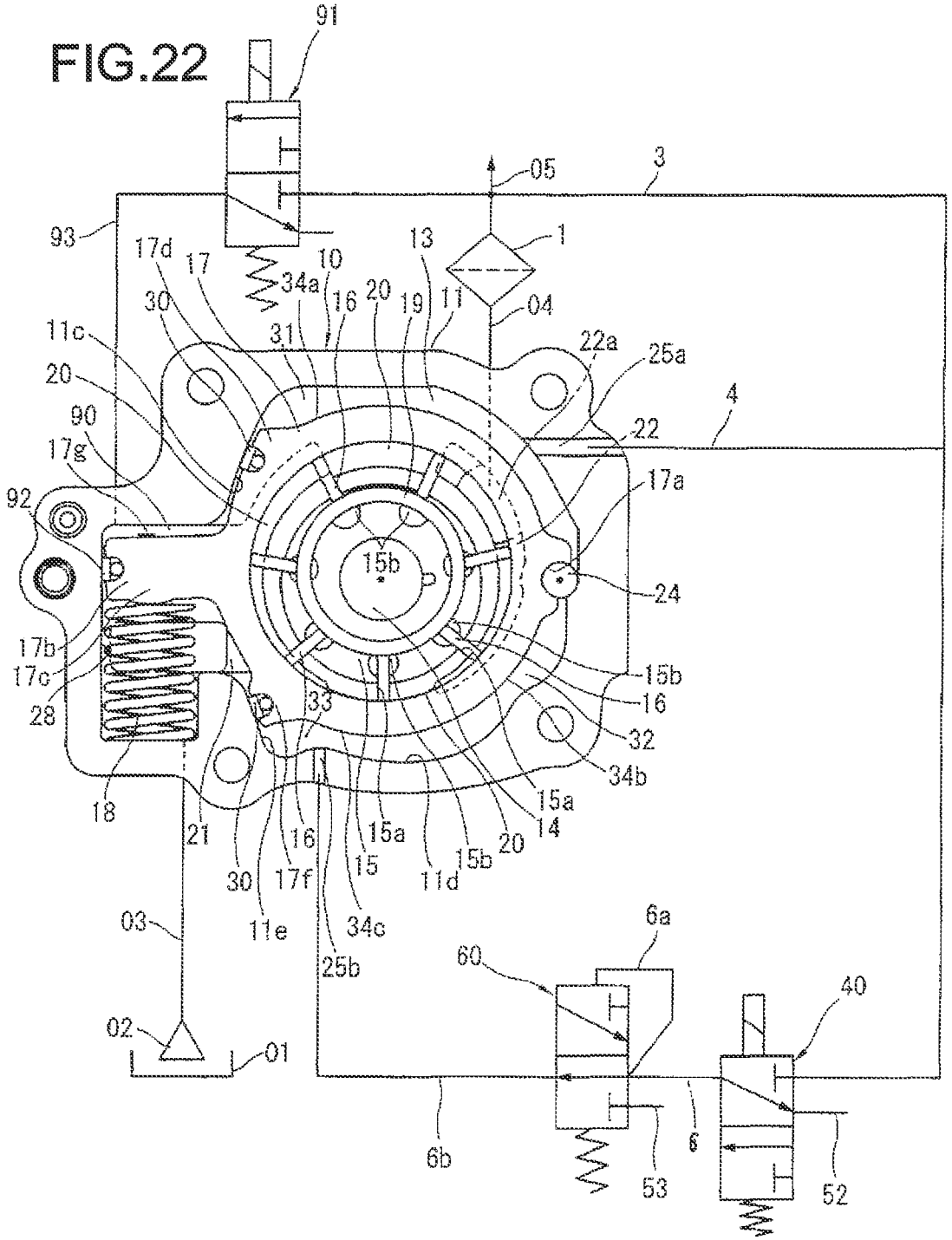
FIG. 22 is an explanatory view for operations of the variable displacement pump in the third embodiment.

When the engine speed rises, the OFF signal is outputted to the third electromagnetic changeover valve 91 whereas the ON signal continues to be outputted to the first electromagnetic changeover valve 40. Hence, as shown in FIG. 22, hydraulic pressures of the fourth control oil chamber 90 and the second control oil chamber 32 are drained so that hydraulic pressure is supplied only to the first control oil chamber 31. Therefore, the discharge pressure of the oil pump 10 is adjusted to the level shown by P2 in FIG. 10.

Figure 23:
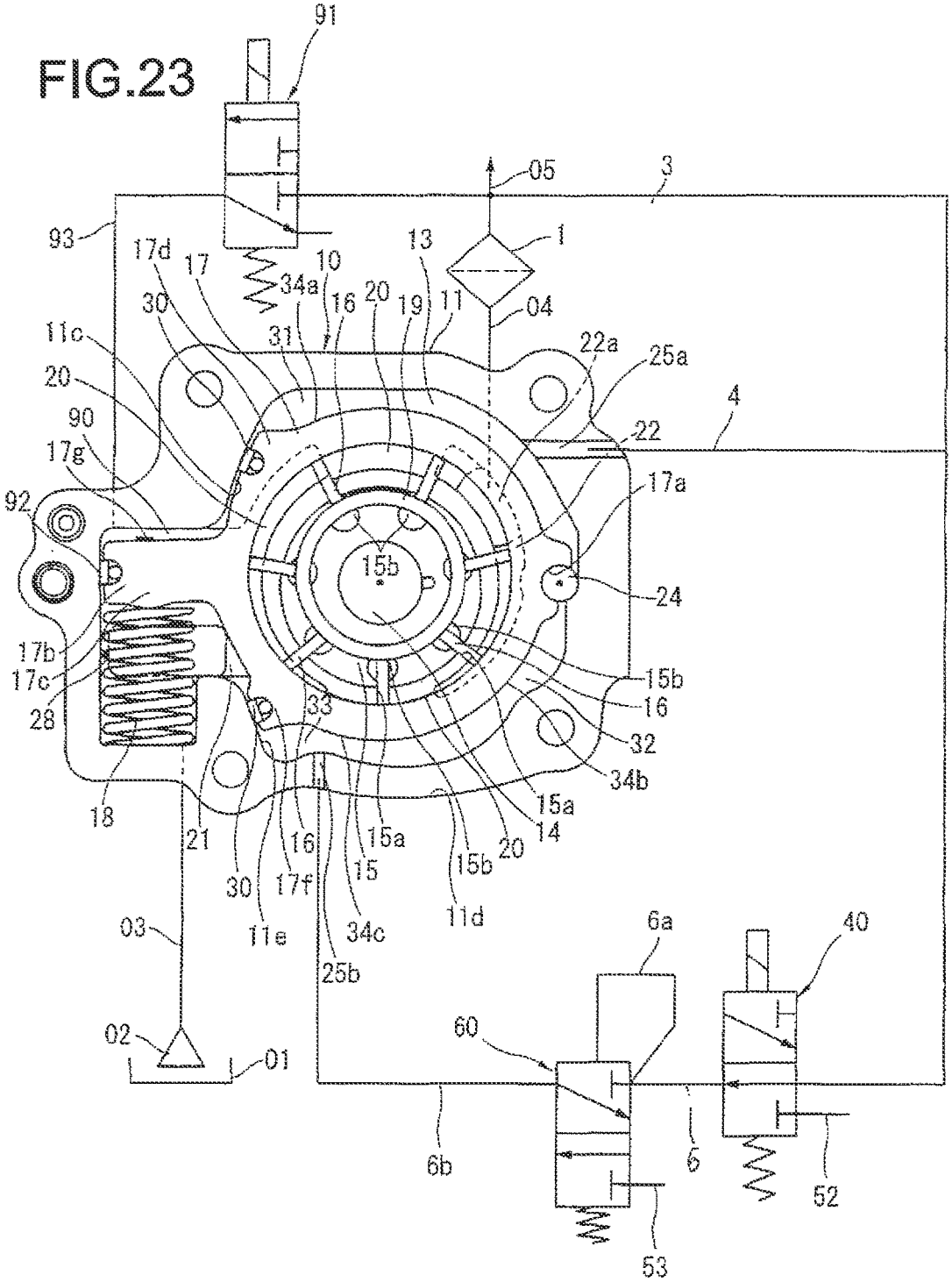
FIG. 23 is an explanatory view for operations of the variable displacement pump in the third embodiment.

When the engine speed further rises, the OFF signal continues to be outputted to the third electromagnetic changeover valve 91 whereas the OFF signal is outputted to the first electromagnetic changeover valve 40. Hence, as shown in FIGS. 18 and 23, hydraulic pressure of the fourth control oil chamber 90 is drained, and the discharge pressure is supplied to the second control oil chamber 32. Therefore, the discharge pressure of the oil pump 10 is adjusted to the level shown by P3 (P3') in FIG. 10, in the same manner as the above.

Moreover, in the case that the ON signal is outputted to the third electromagnetic changeover valve 91 and the OFF signal is outputted to the first electromagnetic changeover valve 40, hydraulic pressure is supplied to each of the first control oil chamber 31, the second control oil chamber 32 and the fourth control oil chamber 90. In this case, the discharge pressure of the oil pump 10 is adjusted to the level shown by P4 in FIG. 10.

Therefore, operations and effects similar to the first embodiment are obtainable.

[Fourth Embodiment]

Figure 24:
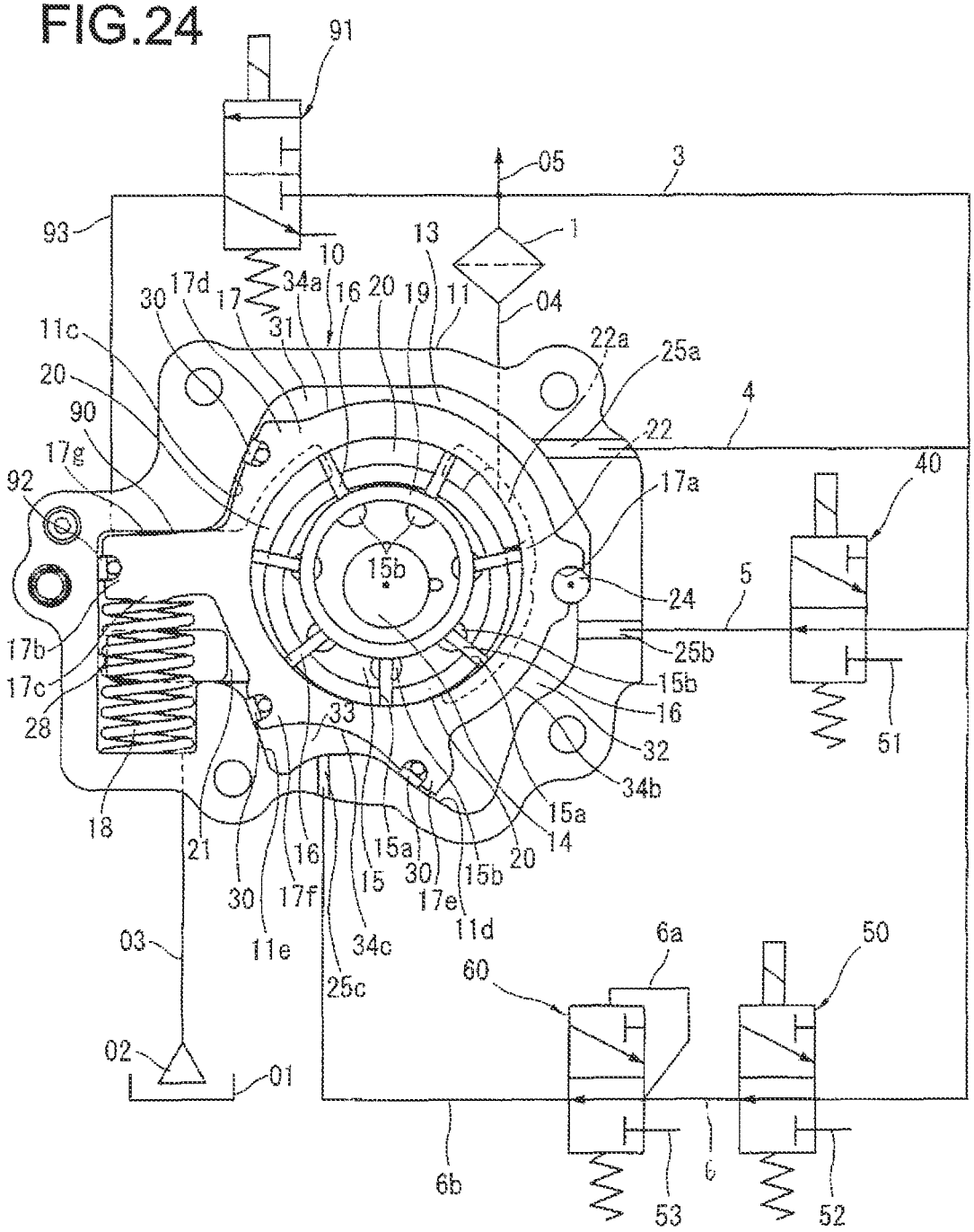
FIG. 24 is a schematic view showing an oil pump and a hydraulic circuit in a variable displacement pump of a fourth embodiment according to the present invention.

FIG. 24 shows a fourth embodiment according to the present invention. A configuration of the fourth embodiment is constructed by adding the fourth control oil chamber 90 and the third electromagnetic changeover valve 91 of the third embodiment to the structure of the oil pump 10 of the first embodiment. That is, in the fourth embodiment, four control oil chambers of the second control oil chamber 32, the third control oil chamber 33, the first control oil chamber 31 and the fourth control oil chamber 90 are provided. The second control oil chamber 32 and the third control oil chamber 33 constitute the increase-side (spring-assist-side) oil chamber group, and the first control oil chamber 31 and the fourth control oil chamber 90 constitute the reduction-side oil chamber group.

The first electromagnetic changeover valve 40 is provided on the first supply/drain passage 5. The second electromagnetic changeover valve 50 is provided on the second supply/drain passage 6. The third electromagnetic changeover valve 91 is provided on the second control passage 93. Moreover, the pilot valve 60 is provided downstream of the second electromagnetic changeover valve 50.

Figure 25:
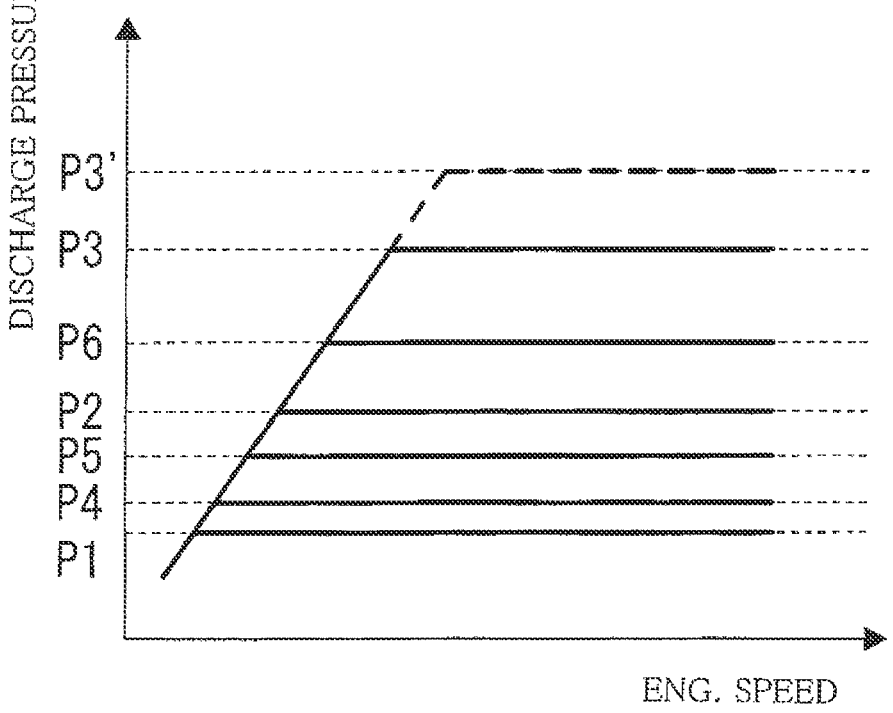
FIG. 25 is a graph showing a relation between the engine speed and a discharge pressure of the variable displacement pump in the fourth embodiment.

As shown in the following table 3, the respective electromagnetic changeover valves 40, 50 and 91 are controlled by ON signal and OFF signal in accordance with the change of the engine speed. Thus, the oil pump 10 is controlled in six working modes to attain the discharge pressures of the oil pump 10 as shown in FIG. 25.

changeover valve 91 and the first electromagnetic changeover valve 40 whereas the ON signal is outputted to the second electromagnetic changeover valve 50. Hence, oils of the fourth control oil chamber 90 and the third control oil chamber 33 are drained to reduce hydraulic pressures therein. At the same time, the discharge pressure is supplied to the first control oil chamber 31 and the second control oil chamber 32. Therefore, the discharge pressure of the oil pump 10 is adjusted to the level shown by P2 in FIG. 25 (Third working mode).

When the engine speed further rises, the OFF signal is outputted to the third electromagnetic changeover valve 91, the first electromagnetic changeover valve 40 and the second electromagnetic changeover valve 50. Hence, hydraulic pressure of the fourth control oil chamber 90 is drained, and the discharge pressure is supplied to the second control oil chamber 32 and the third control oil chamber 33 (Fourth working mode). Therefore, the discharge pressure of the oil pump 10 is adjusted to the level (maximum level) shown by P3 (P3') in FIG. 25, in the same manner as the level shown by P3 (P3') in FIG. 10.

For example, when the engine speed becomes equal to a predetermined level, the OFF signal is outputted to the third electromagnetic changeover valve 91 whereas the ON signal is outputted to the first electromagnetic changeover valve 40 and the second electromagnetic changeover valve 50. Accordingly, hydraulic pressures of the second control oil chamber 32, the third control oil chamber 33 and the fourth control oil chamber 90 are drained (First working mode).

TABLE 3

| | | First control oil chamber | Fourth control oil chamber (Third electromagnetic changeover valve) | Second control oil chamber (First electromagnetic changeover valve) | Third control oil chamber (Second electromagnetic changeover valve) | Discharge pressure |
|---|---|---|---|---|---|---|
| One-chamber introduction | First working mode | SUPPLY | DRAIN (OFF) | DRAIN (ON) | DRAIN (ON) | P1 < P4 < P2 |
| Two-chamber introduction | Second working mode | SUPPLY | SUPPLY (ON) | DRAIN (ON) | DRAIN (ON) | P1 |
| | Third working mode | SUPPLY | DRAIN (OFF) | SUPPLY (OFF) | DRAIN (ON) | P2 |
| Three-chamber introduction | Fourth working mode | SUPPLY | DRAIN (OFF) | SUPPLY (OFF) | SUPPLY (OFF) | P3 (P3') |
| | Fifth working mode | SUPPLY | SUPPLY (ON) | SUPPLY (OFF) | DRAIN (ON) | P4 < P5 < P2 |
| Four-chamber introduction | Sixth working mode | SUPPLY | SUPPLY (ON) | SUPPLY (OFF) | SUPPLY (OFF) | P2 < P6 < P3 |

Accordingly, when the engine speed is in the low-speed region, the ON signal is outputted to the third electromagnetic changeover valve 91 so that the discharge pressure is applied to the fourth control oil chamber 90. At this time, the ON signal is also outputted to the first electromagnetic changeover valve 40 so that oil retained in the second control oil chamber 32 is drained. Moreover, the ON signal is also outputted to the second electromagnetic changeover valve 50 so that oil retained in the third control oil chamber 33 is drained. Therefore, the discharge pressure of the oil pump 10 is adjusted to the level shown by P1 in FIG. 25 (Second working mode).

When the engine speed rises up to a predetermined speed, the OFF signal is outputted to the third electromagnetic Therefore, the discharge pressure of the oil pump 10 is adjusted to the level shown by P4 in FIG. 25. This level P4 is higher than the level P1 and lower than the level P2.

For example, when the engine speed becomes equal to a further different predetermined level, the ON signal is outputted to the third electromagnetic changeover valve 91 and the second electromagnetic changeover valve 50 whereas the OFF signal is outputted to the first electromagnetic changeover valve 40. Accordingly, the discharge pressure is supplied to the fourth control oil chamber 90 and the second control oil chamber 32 whereas oil retained in the third control oil chamber 33 is drained (Fifth working mode). Therefore, the discharge pressure of the oil pump 10 is adjusted to the level shown by P5 in FIG. 25. This level P5 is higher than the level P4 and lower than the level P2.

For example, when the engine speed becomes equal to a further different predetermined level, the ON signal is outputted to the third electromagnetic changeover valve 91 whereas the OFF signal is outputted to the first electromagnetic changeover valve 40 and the second electromagnetic changeover valve 50. Accordingly, the discharge pressure is supplied to the fourth control oil chamber 90, the second control oil chamber 32 and the third control oil chamber 33 (Sixth working mode). Therefore, the discharge pressure of the oil pump 10 is adjusted to the level shown by P6 in FIG. 25. This level P6 is higher than the level P2 and lower than the level P3.

In the fourth embodiment, the discharge pressure of the oil pump 10 can be controlled to take the six stages (seven stages) in accordance with the change of the engine speed, as explained above.

A failsafe against abnormal circumstances such as a failure of the first electromagnetic changeover valve 40 or the second electromagnetic changeover valve 50 is necessary to ensure the state where the discharge pressure of the oil pump 10 is high when the engine speed, the engine load and/or the oil temperature are high. That is, in the fourth embodiment, when no electric-current is supplied to the coil of the first electromagnetic changeover valve 40 (or the second electromagnetic changeover valve 50), the first electromagnetic changeover valve 40 (or the second electromagnetic changeover valve 50) communicates the solenoid opening port 42*a* with the communication port 45 such that the discharge pressure is applied to the second control oil chamber 32 (or the third control oil chamber 33) regardless of failures such as a disconnection trouble of the coil or harness of the first electromagnetic changeover valve 40 (or the second electromagnetic changeover valve 50).

Although the invention has been described above with reference to certain embodiments of the invention, the invention is not limited to the embodiments described above. Modifications and variations of the embodiments described above will occur to those skilled in the art in light of the above teachings.

For example, the number of the control oil chambers may be further increased in order to control the discharge pressure of the oil pump 10 more finely.

Next, some configurations obtainable from the above embodiments according to the present invention will now be listed.

[a] According to the above embodiments, the control mechanism (corresponding to reference signs 40, 50, 60, 70 and 91) configured to control oil quantity which is supplied to each control oil chamber can be constituted by a plurality of electromagnetic changeover valves.

[b] According to the above embodiments, the control mechanism (corresponding to reference signs 40, 50, 60, 70 and 91) can also be constituted by only one electromagnetic changeover valve.

[c] According to the above embodiments, the total number of control oil chambers of the reduction-side oil chamber group and the increase-side oil chamber group can be four.

[d] According to the above embodiments, the reduction-side oil chamber group can include two control oil chambers while the increase-side oil chamber group also includes two control oil chambers.

[e] According to the above embodiments, each control oil chamber of the reduction-side oil chamber group and the increase-side oil chamber group is located radially outside the movable member (corresponding to reference sign 17).

[f] According to the above embodiments, the swing fulcrum (corresponding to reference sign 24) for the movable member is provided on the outer circumferential surface of the movable member, and the reduction-side oil chamber group and the increase-side oil chamber group are separated from each other by the swing fulcrum.

[g] According to the above embodiments, the discharged oil is supplied to the reduction-side oil chamber group, and supplied to or drained from at least two control oil chambers of the increase-side oil chamber group such that the pressure of the discharged oil is controlled in three stages.

[h] According to the above embodiments, the pressure of the discharged oil is adjusted to a first level of the three stages which is suitable for a drive source of a valve-timing control device, to a second level of the three stages which is suitable for an oil jet for spraying oil to a piston of the internal combustion engine, and to a third level of the three stages which is suitable for oil supply to a bearing for a crankshaft.

[i] According to the above embodiments, the discharged oil is supplied to the reduction-side oil chamber group and supplied to or drained from the increase-side oil chamber group such that the discharge pressure is controlled in four stages.

[j] According to the above embodiments, the discharge pressure can also be adjusted to a first level of the four stages which is suitable for the drive source of the valve-timing control device, to a second level of the four stages which is suitable for a first state of the oil jet for spraying oil to the piston of the internal combustion engine, to a third level of the four stages which is suitable for a second state of the oil jet for spraying oil to the piston, and to a fourth level of the four stages which is suitable for oil supply to the bearing for the crankshaft.

[k] According to the above embodiments, the discharged oil is supplied to one control oil chamber of the reduction-side oil chamber group and at least one control oil chamber of the increase-side oil chamber group, and selectively supplied to or drained from another control oil chamber of the reduction-side oil chamber group such that the discharge pressure is controlled in the four stages.

This application is based on prior Japanese Patent Application No. 2014-45813 filed on Mar. 10, 2014. The entire contents of this Japanese Patent Application are hereby incorporated by reference.

The scope of the invention is defined with reference to the following claims.

What is claimed is:

1. A variable displacement pump comprising:

a rotationally driven rotor, a plurality of vanes movable out from and into the rotor, a cam ring, wherein the rotor, the plurality of vanes, and the cam ring form a plurality of pump chambers and are configured to suck and discharge oil by volume variations of the plurality of pump chambers;

a pump body housing the rotor, the plurality of vanes, and the cam ring;

at least three control oil chambers configured to move the cam ring within the pump body by a supply of oil discharged from the plurality of pump chambers to change rates of the volume variations of the plurality of pump chambers, wherein the at least three control oil chambers include at least one reduction-side control oil chamber provided to move the cam ring in a direction that reduces the rates of the volume variations of the plurality of pump chambers and two increase-side control oil chambers configured to move the cam ring in a direction that increases the rates of the volume variations of the plurality of pump chambers;

a spring provided to have a set load and to bias the cam ring in the direction that increases the rates of the volume variations of the plurality of pump chambers; and two electromagnetic changeover valves, each of the two electromagnetic changeover valves being configured to control each quantity of oil supplied to the two increase-side control oil chambers.

2. The variable displacement pump according to claim 1, wherein the two electromagnetic changeover valves selectively supply or drain to/from each of the two increase-side control oil chambers, based on exciting current.

3. The variable displacement pump according to claim 1, wherein the cam ring is swingable by a pivot pin, the pivot pin being disposed between the cam ring and the pump body.

4. The variable displacement pump according to claim 3, wherein the reduction-side control oil chamber and the two increase-side control oil chambers are divided into two by the pivot pin.

5. The variable displacement pump according to claim 4, wherein the reduction-side oil chamber and the two increase-side control oil chambers are divided by sealing slide-contact surfaces formed on a plurality of locations of the pump body and a plurality of seal members disposed on the cam ring, distances from the respective seal slide-contact surfaces to the pivot pin being different.

6. A variable displacement pump comprising:

a rotationally driven rotor, a plurality of vanes movable out from and into the rotor, a cam ring, wherein the rotor, the plurality of vanes, and the cam ring form a plurality of pump chambers and are configured to suck and discharge oil by volume variations of the plurality of pump chambers;

a pump body housing the rotor, the plurality of vanes, and the cam ring;

at least three control oil chambers configured to move the cam ring within the pump body by a supply of oil discharged from the plurality of pump chambers to change rates of the volume variations of the plurality of pump chambers, wherein the at least three control oil chambers include at least one reduction-side control oil chamber provided to move the cam ring in a direction that reduces the rates of the volume variations of the plurality of pump chambers and two increase-side control oil chambers configured to move the cam ring in a direction that increases the rates of the volume variations of the plurality of pump chambers;

a spring member provided to have a set load and to bias the cam ring in the direction that increases the rates of the volume variations of the plurality of pump chambers; and a single electromagnetic changeover valve configured to control each quantity of oil supplied to the two increase-side control oil chambers.

7. A variable displacement pump comprising:

a rotationally driven rotor, a plurality of vanes movable out from and into the rotor, a cam ring, wherein the rotor, the plurality of vanes, and the cam ring form a plurality of pump chambers and are configured to suck and discharge oil by volume variations of the plurality of pump chambers;

a pump body housing the rotor, the plurality of vanes, and the cam ring;

at least three control oil chambers configured to move the cam ring within the pump body by a supply of oil discharged from the plurality of pump chambers to change rates of the volume variations of the plurality of pump chambers, wherein the at least three control oil chambers include at least one reduction-side control oil chamber provided to move the cam ring in a direction that reduces the rates of the volume variations of the plurality of pump chambers and two increase-side control oil chambers configured to move the cam ring in a direction that increases the rates of the volume variations of the plurality of pump chambers;

a spring provided to have a set load and to bias the cam ring in the direction that increases the rates of the volume variations of the plurality of pump chambers; and at least two changeover valves configured to control each quantity of oil supplied to the two increase-side control oil chambers.

8. The variable displacement pump according to claim 7, wherein the at least two changeover valves are respectively constituted by a first electromagnetic changeover valve and a second electromagnetic changeover valve.

9. The variable displacement pump according to claim 7, wherein the at least two changeover valves are constituted by a single electromagnetic changeover valve.

10. The variable displacement pump according to claim 7, further comprising another reduction-side control oil chamber and another electromagnetic changeover valve, the other electromagnetic changeover valve controlling oil supplied to the other reduction-side control oil chamber.

* * * * *